US010000991B2

(12) United States Patent
Harris et al.

(10) Patent No.: US 10,000,991 B2
(45) Date of Patent: Jun. 19, 2018

(54) FRAC PLUG

(71) Applicant: Tercel Oilfield Products USA LLC

(72) Inventors: Michael J. Harris, Houston, TX (US); Kenneth J Anton, Magnolia, TX (US)

(73) Assignee: Tercel Oilfield Products USA LLC, Houston, TX (US)

( * ) Notice: Subject to any disclaimer, the term of this patent is extended or adjusted under 35 U.S.C. 154(b) by 229 days.

(21) Appl. No.: 15/055,696

(22) Filed: Feb. 29, 2016

(65) Prior Publication Data

US 2016/0305215 A1 Oct. 20, 2016

Related U.S. Application Data

(60) Provisional application No. 62/149,553, filed on Apr. 18, 2015.

(51) Int. Cl.

| | |
|---|---|
| ***E21B 33/128*** | (2006.01) |
| ***E21B 33/1295*** | (2006.01) |
| ***E21B 33/134*** | (2006.01) |
| ***E21B 33/129*** | (2006.01) |

(52) U.S. Cl.

CPC ..... *E21B 33/1291* (2013.01)

(58) Field of Classification Search

CPC .... E21B 33/128; E21B 33/129; E21B 33/134; E21B 33/1285; E21B 33/1295; E21B 33/1292; E21B 33/1291; E21B 33/1293

See application file for complete search history.

(56) References Cited

U.S. PATENT DOCUMENTS

| | | | | |
|---|---|---|---|---|
| 3,556,217 | A * | 1/1971 | Anastasiu | E21B 33/129 166/217 |
| 4,901,794 | A | 2/1990 | Baugh et al. | |
| 5,058,672 | A | 10/1991 | Cochran | |
| 5,058,684 | A | 10/1991 | Winslow et al. | |
| 5,271,468 | A | 12/1993 | Streich et al. | |
| 5,511,620 | A | 4/1996 | Baugh et al. | |
| 5,984,007 | A | 11/1999 | Yuan et al. | |
| 6,220,349 | B1 | 4/2001 | Vargus et al. | |
| 6,394,180 | B1 | 5/2002 | Berscheidt et al. | |
| 6,491,116 | B2 | 12/2002 | Berscheidt et al. | |
| 7,090,004 | B2 * | 8/2006 | Warren | E21B 21/10 122/126 |
| 7,431,079 | B1 * | 10/2008 | Chavez | E21B 33/06 166/135 |
| 7,475,736 | B2 | 1/2009 | Lehr et al. | |

(Continued)

FOREIGN PATENT DOCUMENTS

EP 1712729 A2 10/2006

OTHER PUBLICATIONS

International Search Report in corresponding International Application No. PCT/US2016/026349, dated Jul. 1, 2016, 4 pp. (not prior art).

(Continued)

*Primary Examiner* — Kenneth L Thompson
(74) *Attorney, Agent, or Firm* — Keith B. Willhelm

(57) ABSTRACT

A compact and simplified frac plug apparatus is provided with improved drillability. The frac plug includes an annular wedge, a sealing ring, and an annular slip. An adapter kit apparatus is provided for connecting the plug assembly to a setting tool. Methods of operation for setting the plug apparatus in a well are also disclosed.

20 Claims, 14 Drawing Sheets

(56) References Cited

U.S. PATENT DOCUMENTS

| | | | |
|---|---|---|---|
| 7,600,572 | B2 | 10/2009 | Slup et al. |
| 7,740,079 | B2 | 6/2010 | Clayton et al. |
| 7,789,137 | B2 | 9/2010 | Turley et al. |
| 8,047,280 | B2 | 11/2011 | Tran et al. |
| 8,336,616 | B1 | 12/2012 | McClinton |
| 8,469,088 | B2 | 6/2013 | Shkurti et al. |
| 8,579,024 | B2 | 11/2013 | Mailand et al. |
| 8,887,818 | B1 | 11/2014 | Carr et al. |
| 8,950,504 | B2 | 2/2015 | Xu et al. |
| 8,955,605 | B2 | 2/2015 | VanLue |
| 8,985,228 | B2 | 3/2015 | Xu et al. |
| 8,997,853 | B2 | 4/2015 | VanLue |
| 9,010,411 | B1 | 4/2015 | VanLue |
| 9,010,416 | B2 | 4/2015 | Xu et al. |
| 9,033,060 | B2 | 5/2015 | Xu et al. |
| 9,074,439 | B2 | 7/2015 | VanLue |
| 9,080,403 | B2 | 7/2015 | Xu et al. |
| 9,080,416 | B2 | 7/2015 | Xu et al. |
| 9,080,439 | B2 | 7/2015 | O'Malley et al. |
| 9,097,095 | B2 | 8/2015 | VanLue |
| 9,103,177 | B2 | 8/2015 | VanLue |
| 9,121,247 | B2 | 9/2015 | George et al. |
| 9,121,252 | B2 | 9/2015 | George et al. |
| 9,273,526 | B2 | 3/2016 | Oberg et al. |
| 9,284,803 | B2 | 3/2016 | Stone et al. |
| 9,309,733 | B2 | 4/2016 | Xu et al. |
| 9,316,086 | B2 | 4/2016 | VanLue |
| 9,574,415 | B2 | 2/2017 | Xu et al. |
| 9,835,003 | B2 * | 12/2017 | Harris ..... E21B 23/01 |
| 2002/0121379 | A1 | 9/2002 | Doane |
| 2008/0191420 | A1 | 8/2008 | Imhoff et al. |
| 2014/0209325 | A1 | 7/2014 | Dockweiler et al. |
| 2014/0227024 | A1 | 8/2014 | Gilling et al. |
| 2015/0068729 | A1 | 3/2015 | Carr et al. |
| 2015/0129239 | A1 | 5/2015 | Richard |
| 2015/0300121 | A1 | 10/2015 | Xu |
| 2016/0145964 | A1 | 5/2016 | Doane et al. |
| 2016/0186511 | A1 | 6/2016 | Coronado et al. |

OTHER PUBLICATIONS

Owen Oil Tools, Big Bore Frac Plug, 2002, 1 page.
Halliburton, 250-Series Frac Plugs, 2012, 3 pp.
Halliburton, Fas Drill® Bridge Plug, 2014, 2 pp.
Baker Hughes, SHADOW Series Frac Plug, 2014, 2 pp.
Schlumberger, Copperhead Big Bore Flow-Through Frac Plug, 2014, 1 page.
Peak Completions, Set-A-Seat(TM) Pump-Down Casing Baffle, 2014-2015, 2 pp.
Weatherford, TruFrac® Composite Frac Plug, 2015, 4 pp.
GEODynamics® FracDock(TM), 2015, 4 pp.
GEODynamics® SmartStart PLUS(TM), undated, 2 pp.
TAM International, PosiFrac HALO(TM), 2016, 2 pp.
Superior Energy Services, OmniFrac(TM) Systems, undated, 20 pp.
American Completion Tools, *Hydraulic Setting Tool* p. 19 (undated).
American Completion Tools, *Model Fury 05 hydraulic Setting Tool Operation Procedure* pp. 50-52 (undated).
Baker Hughes, *E-4 Wireline Pressure Setting Assembly and Baker Hughes C Firing Heads* (© 2012-2014).
Baker Hughes, *Model E-4™ Wireline Pressure Setting Assemblies* (© 2014).
Evonik Industries, *CAMPUS® Datasheet—VESTKEEP® L 4000 G-PEEK* (Aug. 25, 2016).
Evonik Industries, *Product Information—VESTAKEEP® L4000G High-Viscosity, Unreinjorced Polyether Ether Ketone* (Oct. 2011).
Evonik Industries, *VESTAKEEP® PEEK—Polyether Ether Ketone Compounds* (undated).
Evonik Industries, *VESTAKEEP® Peek Offers the Strongest Bonding Strength to Withstand Strict Operating Environmental Conditions* (Oct. 27, 2014).
Halliburton, *Wireline Setting Tools* (© 2015).
High Pressure Integrity, Inc., *Direct Pump Setting Tool DPST—Chapter 6* (© 2008 Weatherford).
Schlumberger, *Diamondback Composite Drillable Frac Plug* (© 2016).
Schlumberger, *Model E Hydraulic Setting Tool* (© 2014).
Unknown, *Baker Style #20 Setting Tool* (undated).
Weatherford, *TruFrac® Composite Frac Plug—Optimizing Costs in Plug-and-Perf Operations* (undated).
Baker Hughes Inc., *Torpedo Composite Frac Plug—Overview* (Copyright 2017).
Downhole Technology LLC, *Boss Hog Features at a Glance*, www.downholetechnology.com/features-benefits/boss-hog-at-a-glance (Jun. 5, 2017).
European Patent Office, *Invitation to Pay Additional Fees and, Where Applicable, Protest Fee*, dated May 10, 2017.
Halllburton, *Obsidian® Frac Plug* (Copyright 2015).
Magnum Oil Tools Int'l. *Composite Frac Plugs—Magnum Series* (May 16, 2017).
Nine Energy Service, *Scorpion High-Quality, Fully Composite Plugs* (undated).
Schlumberger, *Diamondback Composite Drillable Frac Plug* (Copyright 2016).
Weatherford, *TruFrac® Composite Frac Plug* (undated).

* cited by examiner

FRAC PLUG

BACKGROUND OF THE INVENTION

Field of the Invention

This invention relates generally to a frac plug or bridge plug that can be used to seal or isolate a portion of a well. More particularly, this invention relates to a frac plug or a bridge plug using an assembly of wedges, slips and seals for sealing or isolating portions of a casing bore in a well.

Generally, frac plugs and bridge plugs are devices that have been used to selectively close or isolate sections of a well and can be used either alone or in combination with other plugs, packers and downhole tools. Wells drilled into the ground, particularly oil, gas and water wells, generally define a bore that extends for some length underground. Sections of a well bore extending from the surface can be lined with a casing for some length. Some wells produce fluids or inject fluids into ground formations. The fluids generally flow through the openings in the bottom of such casing or through holes that may be perforated in the sides of the casing. By isolating sections of a well, frac plugs and bridge plugs permit well operators to produce fluids from or inject fluids into selected perforations and openings in different zones of the well.

Operators may need to produce fluid from or inject fluids into certain portions of a well for various reasons. For example, an operator may want to test the ability of only certain formations to produce petroleum fluids or may want to treat certain formations by injecting fluids under pressure into only selected formations. Accordingly an operator may set plugs packers and tubing strings above or below particular perforations or openings in the casing to access only the desired portions of the well and isolate the remainder.

Frac plugs are a type of bridge plug that can be useful in a fracking process. Frac plugs generally can include a check valve that permits the flow of well fluid from one side of the plug to the other, but prevents flow in the reverse direction. In some frac plugs this has been achieved by having an axial bore through the middle of the plug that can be sealed by dropping a ball into the well, known as a frac ball that is designed to occlude the bore of the plug. To promote a fluid-tight seal, the plug can include a seat around the bore to mate with the frac ball.

A plug may be set in the casing of a well by wireline, coiled tubing or conventional pipe. The plug is often set by attaching it to a wireline setting tool. Conventionally, the setting tool may include a ram disposed along the tool's longitudinal axis and a concentrically located annular sleeve. A plug can be connected to the sleeve and the ram using adapters so that actuating members and surfaces mate with the setting tool, as required. The setting tool sets the plug with an axial motion of the ram relative to the sleeve. Once set, the setting tool disengages from the plug and can be returned to the surface.

Thus, in a procedure commonly used to set a plug, the plug is lowered through the casing to a desired location, where the setting tool is actuated. Plugs generally include one or two cone and slip sets that are mounted on a central cylindrical core, or mandrel together with an elastomeric sealing element. The setting tool pushes the cone axially on the mandrel, forcing the cone to slide into the slip (or two slips if the plug is to hold in both directions). With its axial motion, the wedge shape of the cone forces the slip radially outwards to jam the slip between the cone and the casing. The slip can be of a unitary construction, in which case it fragments or expands radially. Alternatively slips have been formed from an annular arrangement of separate wedge-shaped segments which simply separate as they are pushed radially into the casing. The sealing element is also pushed radially outward to contact and seal against the inside wall of the casing. Increasing fluid pressure differential across the plug normally increases the sealing force.

However, the need to inject fluids into or produce fluids from a particular section of a well can be temporary. For example, after testing or treating certain formations at certain portions or zones in the well, the operator may want to produce from, test or treat other formations instead of or in addition to the portions of the well previously accessed. Accordingly, retrieving or removing frac plugs and bridge plugs from wells can be desirable.

Some plugs are not retrievable because the slips are not designed to release and retract but to be removed by milling or drilling. The slips alone may be milled, releasing the plug to be pushed or pulled along the casing But in some applications, it is desirable to remove the entire plug by drilling or milling it to form cuttings of a size that can be removed from the casing by flow of fluid. The time required to mill or drill a bridge plug from a well is very important, particularly when the bridge plug is used in high-cost operations or when multiple bridge plugs are set in a casing for fracturing multiple intervals along a horizontal section of a well. Also, it is often important to remove the plug without damaging the inside wall of the casing. Therefore, some plugs have been made of a material that drills easily. But use of these special materials can increase expense.

A mill or drill bit may be used to reduce the components of the bridge plug to a size such that they can be circulated from the wellbore by drilling fluid. Since a conventional junk mill will normally damage the inside surface of casing, it is preferable to use a bit, such as a PDC bit, that has a smooth gage surface, to avoid casing damage. In prior art bridge plugs, it has been found that lower components of the bridge plug may no longer engage the mandrel during drilling or milling of the plug, allowing them to spin or rotate within the casing and greatly increase the time required for drilling. Interlocking surfaces at either end of a bridge plug are needed to allow drilling of multiple bridge plugs without rotation.

In an attempt to solve some of the known problems of plugs, some plugs designs have also become more complex and have included additional parts. But increased complexity and a greater number of parts can increase cost of the plug as well as the time needed to drill out the plug. Accordingly, for maximum value, a simple, inexpensive plug is needed that can be drilled quickly without damaging the surface of the casing.

SUMMARY OF THE INVENTION

In one embodiment a plug apparatus includes an annular wedge having a wedge first end and a wedge second end. The wedge includes an axial wedge passage therethrough from the wedge first end to the wedge second end. The wedge includes an inner seat defined in the wedge passage for receiving and seating a ball. The wedge has a tapered outer surface adjacent the wedge second end. The tapered outer surface increases in outside diameter from the wedge second end toward but not necessarily all the way to the wedge first end. A sealing ring is received about the tapered outer surface of the wedge. The sealing ring is radially expandable. An annular slip has a slip first end and a slip second end. The slip has an axial slip passage therethrough from the slip first end to the slip second end. The slip passage has a tapered inner surface adjacent the slip first end. The tapered inner surface decreases in inside diameter from the slip first end toward but not necessarily all the way to the slip second end. The wedge second end is received in the slip first end so that the tapered outer surface of the wedge engages the tapered inner surface of the slip. The slip first end faces the sealing ring for abutment with the sealing ring.

The annular slip can include a plurality of separate slip segments. The annular wedge can also include a plurality of collet fingers extending from the wedge second end and circumferentially spaced to form slots between the collet fingers, each collet finger extending through the axial slip passage to a distal end beyond the slip second end. The plug apparatus can further include a setting ring having an outer diameter, slidably mounted around the collet fingers between the slip second end and the distal end of each collet finger. The setting ring can have a first radial thickness and one or more keys that protrude radially inward into one or more of the slots from the first radial thickness to a second radial thickness. The plug apparatus can further include a gauge ring fixably connected to the distal end of the collet fingers having an outer diameter at least the same as the outer diameter of the setting ring or greater. As an alternative option, the setting ring can be located adjacent to the gauge ring and to the slip second end, and the gauge ring can include a peripheral annular wall that extends around the setting ring and extends at least to the slip second end.

According to one aspect, the setting ring is slidable between an unset position and a set position. In the unset position, the slip and the sealing ring are each in a first radial position wherein the setting ring is located adjacent to the gauge ring and to the slip second end. In the set position, the slip and the sealing ring are each radially expanded from the first radial position to a second radial position, wherein the setting ring is displaced along the collet fingers towards the wedge second end and the adjacent slip and sealing ring are correspondingly displaced towards the wedge first end.

The plug apparatus can yet further include a mandrel connected to a setting tool, the mandrel extending through the axial wedge passage and releasably coupled to the setting ring via a frangible coupling. The plug apparatus can still further include an annular sleeve adapter connected to the setting tool and coupled to the first wedge end of the annular wedge, wherein the setting tool is configured to displace the mandrel axially relative to the annular sleeve adapter and thereby move the setting ring from the unset position to the set position.

In an alternative embodiment, a plug apparatus comprises an annular slip formed from a plurality of separate slip segments disposed adjacently to one another. The slip has an upper end and a lower end, and a slip bore that extends from the slip's upper end to its lower end and is also inwardly tapered from the upper end toward the lower end. The plug apparatus further comprises a wedge with a tapered lower outer surface portion that is received in the upper end of the slip and engages the tapered slip bore. The wedge includes a wedge bore with an upwardly facing annular seat defined therein. A plurality of collet fingers, circumferentially spaced in an annular arrangement, extends axially from a lower end of the tapered lower outer surface portion of the wedge. Each collet finger extends through the slip bore to a distal end beyond the slip lower end. A setting ring is slidably located on the plurality of collet fingers between the slip lower end and the distal end of the collet fingers abuts the slip lower end. The plug apparatus yet further comprises a sealing ring received about the tapered lower outer surface portion of the wedge above the slip upper end and is configured to be engaged by the slip upper end.

A method is disclosed for setting a plug in a casing bore, the method comprising:

(a) initially retaining a wedge and a slip in an unset axially extended position with a lower tapered outer surface of the wedge received in an upper tapered inner bore of the slip, and with a sealing ring received about the wedge above the slip and engaged with an upper end of the slip;

(b) while the wedge and the slip are retained in the unset position, running the plug into a casing to a casing location to be plugged; and (c) setting the plug in the casing by forcing the wedge axially into the slip and the sealing ring, thereby;

(1) radially expanding the slip to anchor the plug in the casing; and (2) radially expanding the sealing ring to seal between the plug and the casing.

In another embodiment an adapter apparatus is provided for attaching a plug onto a downhole setting tool. The setting tool including an inner setting tool part and an outer setting tool part. The setting tool is configured to provide a relative longitudinal motion between the inner and outer setting tool parts. The adapter apparatus includes an outer adapter portion configured to be attached to the outer setting tool part, the outer adapter portion including downward facing setting surface. The adapter apparatus further includes an inner adapter portion configured to be attached to the inner setting tool part, the inner adapter portion including an inner mandrel, a release sleeve, and a releasable connector. The release sleeve is slidably received on the inner mandrel, the release sleeve carrying an upward facing setting surface. The releasable connector is configured to hold the release sleeve in an initial position relative to the inner mandrel until a compressive force transmitted between the downward facing setting surface and the upward facing setting surface exceeds a predetermined release value.

In another embodiment an adapter apparatus is provided for attaching a plug onto a downhole setting tool. The setting tool including an inner setting tool part and an outer setting tool part. The setting tool is configured to provide a relative longitudinal motion between the inner and outer setting tool parts. The adapter apparatus includes an outer adapter portion configured to be attached to the outer setting tool part, the outer adapter portion including downward facing setting surface. The adapter apparatus further includes an inner adapter portion configured to be attached to the inner setting tool part, the inner adapter portion including an inner mandrel, a release sleeve, and a releasable connector. The release sleeve is slidably received on the inner mandrel, the release sleeve carrying an upward facing setting surface. The releasable connector is configured to hold the release sleeve in an initial position relative to the inner mandrel until a compressive force transmitted between the downward facing setting surface and the upward facing setting surface exceeds a predetermined release value.

A method is provided for setting a plug assembly in a casing bore, the method comprising:

(a) connecting the plug assembly in an initial arrangement with a setting tool using an adapter kit, the initial arrangement including:

the plug assembly including a plug wedge in an initial position partially received in a plug slip, with a sealing ring received around the plug wedge adjacent an end of the slip;

the plug wedge and plug slip being received about an inner part of the adapter kit, with an upward facing setting surface of the inner part facing a lower end of the plug assembly; and an outer part of the adapter kit including a downward facing setting surface facing an upper end of the plug assembly;

(b) running the plug assembly, the adapter kit and the setting tool into the casing bore in the initial arrangement;

(c) setting the plug assembly in the casing bore by actuating the setting tool and compressing the plug assembly between the upward facing and downward facing setting surfaces; and (d) releasing the plug assembly from the adapter kit.

Numerous objects, features and advantages of the present invention will be readily apparent to those skilled in the art upon reading of the following disclosure when taken into conjunction with the accompanying drawings.

BRIEF DESCRIPTION OF THE DRAWINGS

FIG. 5 shows the plug assembly in an unset position, in place within a casing bore. It will be understood that the plug assembly shown in FIG. 5 has been run into the well with a tool string including the setting tool and adapter kit apparatus of FIGS. 1A-1B. The setting tool and adapter kit apparatus are not shown in FIGS. 5-7 for ease of illustration of the operation of the plug assembly.

FIG. 6 is a view similar to FIG. 5 after the plug assembly has been set in the casing bore, but before the plug assembly is closed with a ball.

FIG. 7 is a view similar to FIG. 6 showing a ball seated on the upper seat of the plug assembly closing the bore of the plug assembly against the downward fluid flow therethrough.

In FIG. 12, the adapter kit apparatus and plug assembly have moved from their initial unset position of FIG. 3 to a set position wherein the plug assembly has been axially compressed to anchor the same within the casing bore and to seal the same against the casing bore.

In FIG. 13, the shear pin holding the inner mandrel and the collet sleeve of the adapter kit apparatus together have sheared and the inner mandrel has begun to move upward relative to the collet sleeve.

In FIG. 14, the inner mandrel and the outer setting sleeve of the adapter kit apparatus have both moved upward until the inner mandrel bottoms out against the reduced diameter inner shoulder of the collet sleeve and the inner mandrel is about to begin to pull the collet sleeve upward out of the plug assembly.

In FIG. 15, the adapter kit apparatus has been pulled further upward relative to FIG. 14, and the collet arms of the collet sleeve have been biased radially inward and are pulled partially through the bore of the plug assembly. Further upward movement of the adapter kit apparatus from the position of FIG. 15 will pull the collet arms completely out of the plug assembly.

DETAILED DESCRIPTION

Figure 1A:
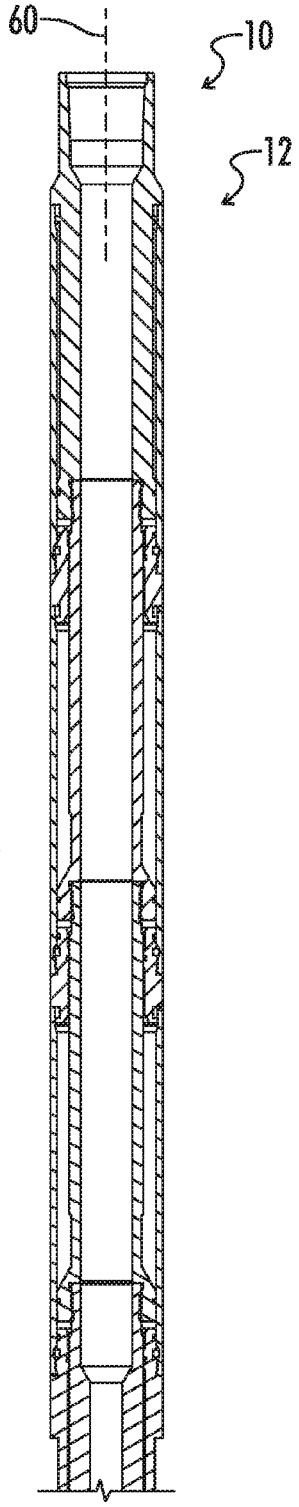
FIGS. 1A-1B comprise an elevation section view of a tool string including a setting tool, an adapter kit apparatus, and a plug assembly.
Figure 1B:
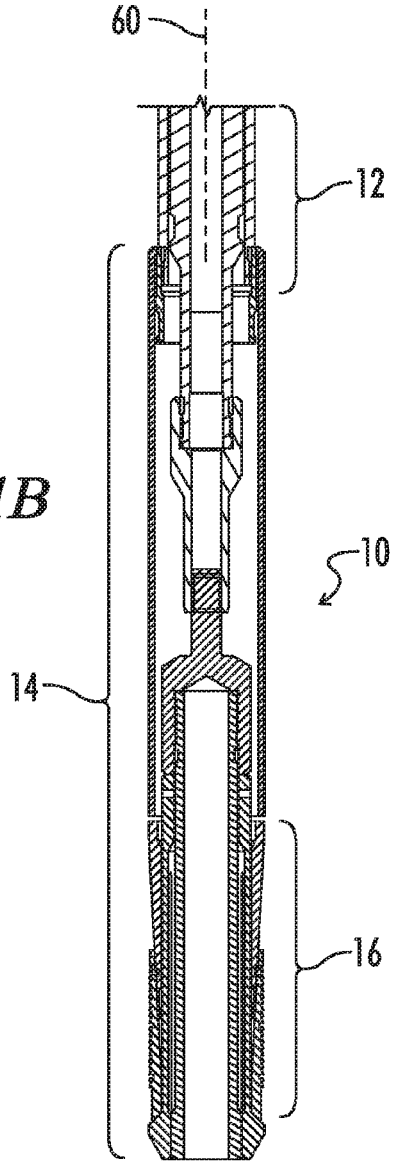
Figure 2A:
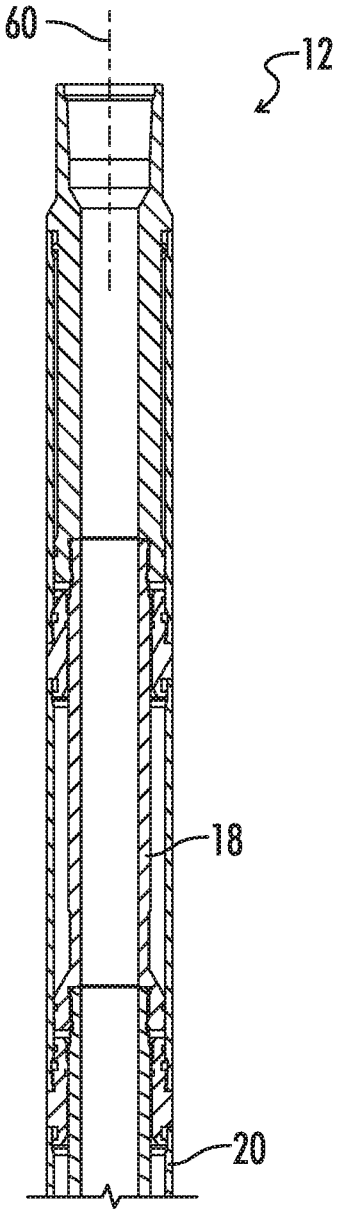
FIGS. 2A-2B comprise an enlarged elevation section view of the setting tool of FIGS. 1A-1B, with the lower end of the setting tool shown connected to the upper end of the adapter kit apparatus.
Figure 2B:
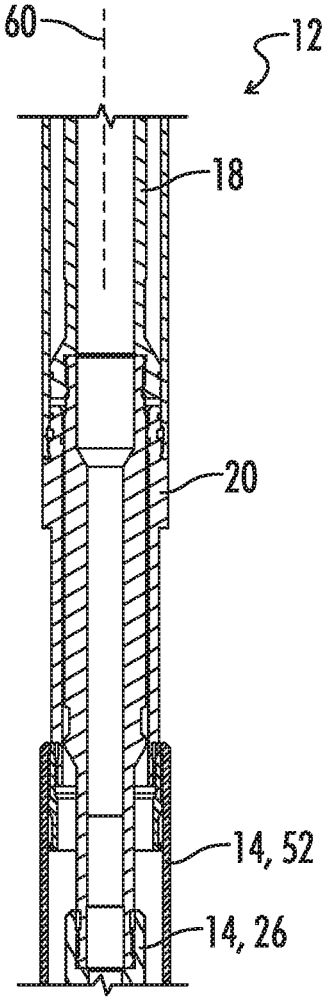

Referring now to FIGS. 1A-1B, a portion of a tool string is shown and generally designated by the numeral 10. The tool string 10 will be understood to be only a portion of a string of tools that will be run into a tubular casing of a well. It will be understood that the portion of the tool string 10 seen in FIGS. 1A-1B will be connected to a lower end of a wireline or e-line unit, a coil tubing string, or any other known system for running tools into a well bore.

The tool string 10 includes a setting tool 12, an adapter kit apparatus 14, and a plug assembly 16. An upper end of the adapter kit apparatus 14 is connected to the setting tool 12. The plug assembly 16 is carried on a lower portion of the adapter kit apparatus 14. The plug assembly 16 may also be referred to as a bridge plug or as a frac plug. When the terms "upper" and "lower" are used herein they refer to the positions of the tool when located in the well bore with the "upper" end of a component being oriented toward the upper end of the well. It is understood that many portions of the well bore may not be vertically oriented and that the tool may actually be in any orientation as dictated by the well bore orientation.

The setting tool 12 may be any one of a number of conventional prior art setting tools which are readily available. The setting tool 12 may operate electrically, hydraulically, by explosive charge, or by any other suitable technique.

In general, such a setting tool includes a setting tool inner part 18 and a setting tool outer part 20. Upon actuation the setting tool 12 provides a relative axial or longitudinal motion between its inner part 18 and outer part 20 such that the outer part 20 moves downward relative to the inner part 18. Suitable setting tools for use with the adapter kit apparatus 14 and plug assembly 16 of the present invention may for example include: Baker Model E-4 #5, #10 or #20, 3⅝" GO Compact and 3½" GO Shorty Wireline Setting Tools as well as Hydraulic Setting Tools similar to the Weatherford HST or American Completion Tools Fury 20.

Figure 3:
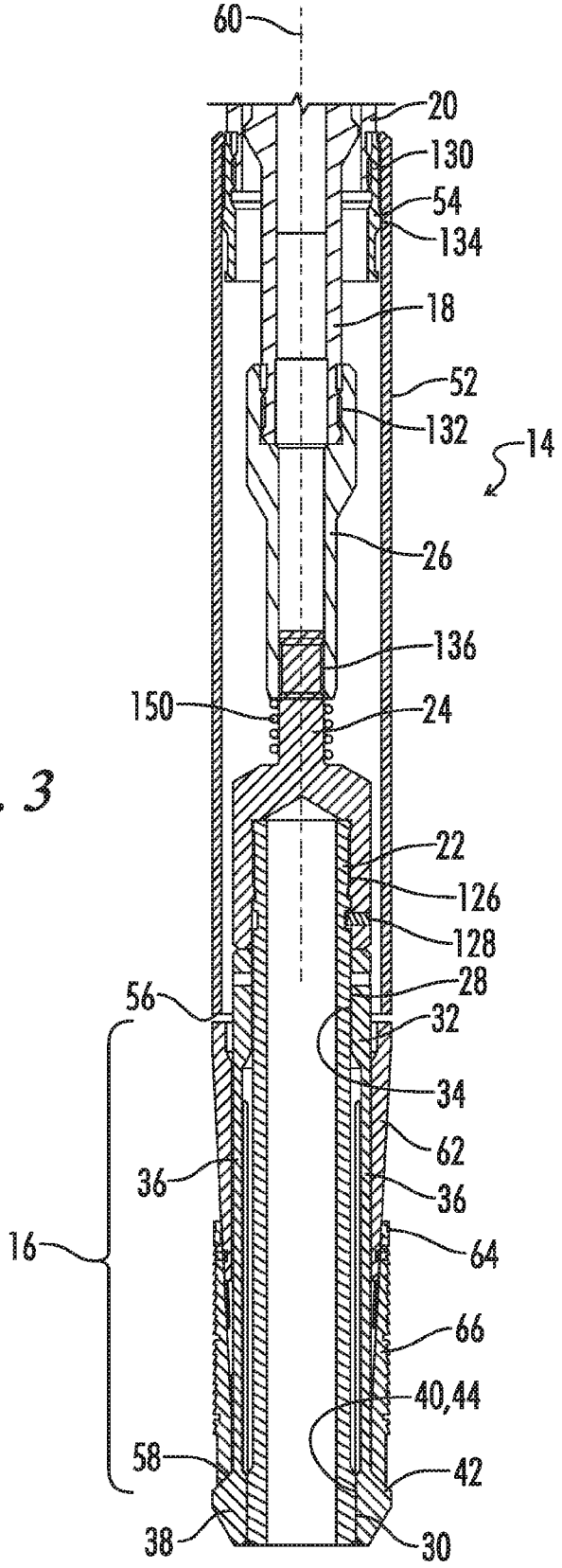
FIG. 3 is an enlarged elevation section view of the adapter kit apparatus and plug assembly of FIGS. 1A-1B.

Referring now to FIG. 3, the adapter kit apparatus 14 is provided for releasably connecting the plug assembly 16 to the setting tool 12.

The plug assembly 16 includes an inner mandrel 22 connected by top cap 24 and an setting tool adapter 26 to the lower end of the setting tool inner part 18. The inner mandrel 22 includes an upper cylindrical outer surface 28 and an enlarged diameter lower cylindrical outer surface 30.

Adapter kit apparatus 14 further includes a release sleeve 32, which may alternatively be referred to as a collet sleeve 32. The release sleeve 32 has a cylindrical inner bore 34 slidably received about the upper cylindrical outer surface 28 of the inner mandrel 22. Integrally formed with the release sleeve 32 is a plurality of collet arms 36 extending downward from the release sleeve 32. Each collet arm 36 includes a collet head 38. Each collet head 38 includes a radially inward extending protrusion 40 and a radially outward extending protrusion 42. The radially inward extending protrusion 40 may be referred to as a locking portion 40 and the radially outward extending protrusion 42 may be referred to as a setting portion 42.

Each radially inward extending protrusion 40 has a radially inner surface 44 slidably engaging the enlarged diameter lower cylindrical outer surface 30 of inner mandrel 22 when the release sleeve is in its initial or upper position relative to the inner mandrel 22 as shown in FIG. 3.

The inner mandrel 42 has an annular groove 46 defined therein which receives a plurality of shear pins 48, each of which extends through a respective radial bore 50 in the upper portion of release sleeve 32. The groove 46 may be referred to as an outwardly facing recess and the bores 50 may be referred to as inwardly facing recesses. Instead of a groove, a series of detents, spotfaces or flat-bottomed holes or other recesses may be machined into the mandrel 42. The plurality of shear pins 48 may be individually or collectively referred to as a connector 48 configured to frangibly connect the release sleeve 32 and the inner mandrel 22 with the release sleeve 32 in its upper position relative to the inner mandrel 22 as illustrated in FIG. 4.

Figure 4:
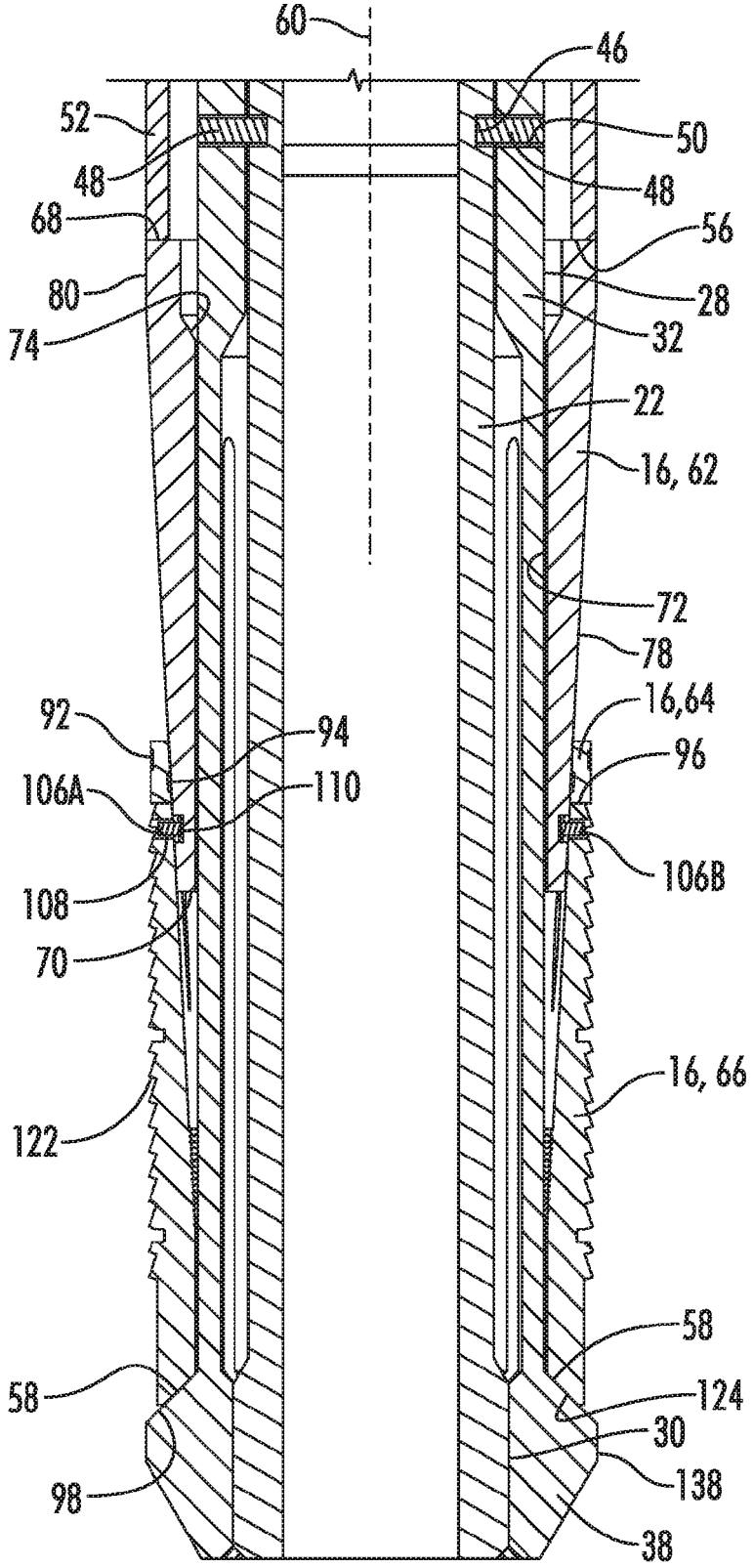
FIG. 4 is a still further enlarged view of the lower end of the adapter kit and the plug assembly of FIG. 3.

As is explained in further detail below, upon actuation of the setting tool 12, the shear pins 48 will initially retain the release sleeve 32 in its upper position as shown in FIG. 4 relative to the inner mandrel 22 until a predetermined setting force has been provided to axially compress the plug assembly 16 and set the same within the casing bore. Then the shear pins 48 will shear allowing the inner mandrel 22 to move upward relative to the release sleeve 32. After the inner mandrel 22 moves upward a sufficient distance the collet arms 36 and collet heads 38 will be biased radially inward allowing the adapter kit apparatus 14 to move upward out of engagement with the plug assembly 16 which at that point will have been set in place within the casing bore.

The adapter kit apparatus 14 further includes an outer setting sleeve 52 configured to be concentrically disposed about and radially spaced from the inner mandrel 22. As seen in FIG. 3, the outer setting sleeve 52 is connected to the lower end of setting tool outer part 20 via an adjusting sleeve 54. It is desirable that the outer surface of the outer setting sleeve 52 be treated with a friction reducing material such as for example Teflon® or other similar material so as to reduce resistance to the movement of the tool assembly through the well bore. This is particularly true when the tool assembly is being pumped into or through a horizontal portion of the well bore.

The outer setting sleeve 52 includes a downward facing lower end 56 which may be referred to as a downward facing setting surface 56.

The radially outward extending protrusion 42 of each of the collet heads 38 includes an upwardly facing setting surface portion 58 defined thereon. As is apparent in FIG. 3, the upwardly facing setting surface setting portions 58 are longitudinally aligned with the downward facing setting surface 56 when the release sleeve 32 is in its upper position relative to inner mandrel 22. This will allow the plug assembly 16 to be compressed between the downwardly facing setting surface 56 and the upwardly facing setting surface portions 58. As is apparent in FIG. 3, the upwardly facing setting surface portions 58 are downwardly outwardly tapered. The downward facing setting surface 56 as shown in FIG. 3 may be substantially normal or perpendicular to a longitudinal axis 60 of the tool string and thus of the outer setting sleeve 52.

Figure 8:
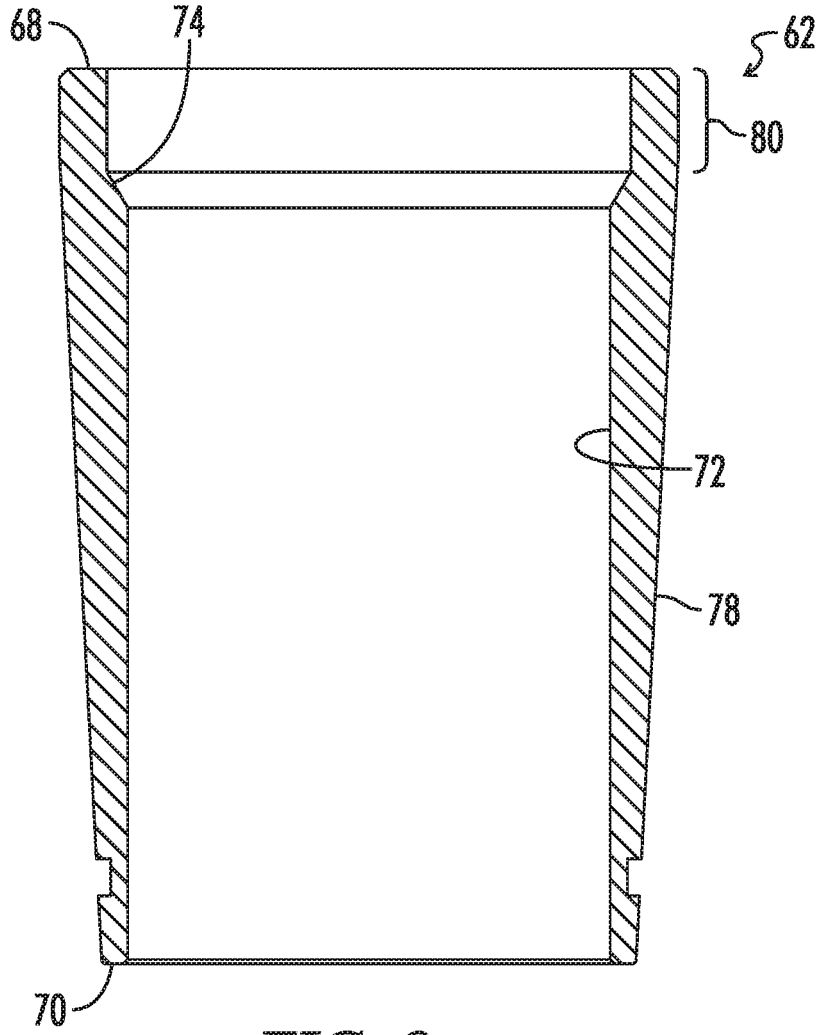
FIG. 8 is an enlarged elevation section view of the annular wedge of the plug assembly.

As best seen in FIG. 4, the plug assembly 16 includes an annular wedge 62, a sealing ring 64 and an annular slip 66. The annular wedge 62 is shown in isolation in FIG. 8. The sealing ring 64 is shown in isolation in FIG. 9. The annular slip 66 is shown in isolation in FIGS. 10 and 11.

Figure 7:
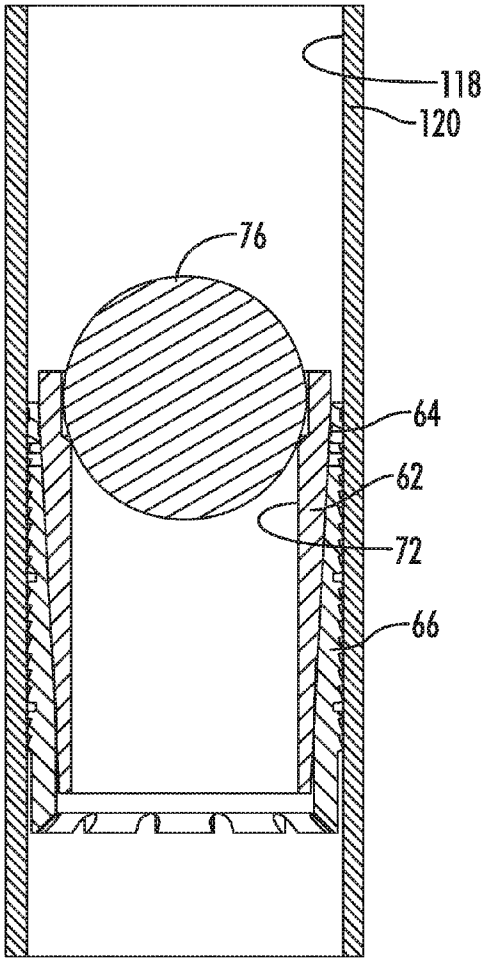
FIGS. 5-7 comprise a sequential series of schematic section elevation views showing the plug assembly of FIGS. 1A-1B as it is placed in a well, set in the casing, and closed with a plug ball.

The annular wedge 62 may be described as having a wedge first end or upper end 68 and a wedge second end or lower end 70. The wedge 62 has an axial wedge passage 72, which may all alternatively be referred to as a wedge bore 72, extending therethrough from the wedge first end 68 to the wedge second end 70. The wedge 62 has an inner seat 74 defined in the wedge passage 72 adjacent the wedge first end 68 or receiving or seating a frac ball 76 such as shown in FIG. 7. It is noted that when any of the tool parts are described herein as including a "bore", that term is only used to indicate that a passage exists and it does not imply that the passage was formed by a boring process or that the passage is axial in alignment to the wellbore, and it does not imply that the passage is a straight cylindrical passage. It is also noted that instead of a ball 76, any other suitable closure device, such as for example a standing valve, may be used to close the wedge bore 72.

The wedge 62 has a tapered outer surface 78 adjacent the wedge second end 70. The tapered outer surface 78 increases in outside diameter from the wedge second end 70 toward the wedge first end 68. It is noted that in the embodiment shown, the wedge 62 includes a non-tapered cylindrical outer surface portion 80 adjacent the wedge first end 68.

Alternatively, the wedge 62 need not be circular in cross-section but instead could have a series of flat ramped surfaces so that in cross-section the wedge outer surface would be polygonal. For such a polygonal cross-section wedge, the associated sealing ring and slip would have to be modified accordingly.

Figure 5:
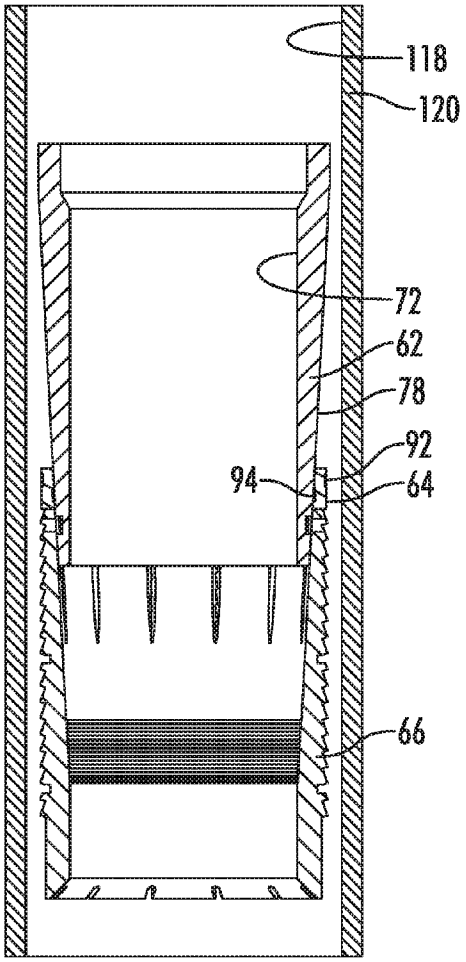

The sealing ring 64 is received about the tapered outer surface 78 of wedge 62, as seen for example in FIGS. 4 and 5. By comparing FIGS. 5 and 6, it can be seen that as the plug assembly 16 is set, the sealing ring 64 is forced upward along the tapered outer surface 78 of the wedge 62 by the upper end 96 of the slip 66, thereby radially expanding the sealing ring 64.

Figure 9:
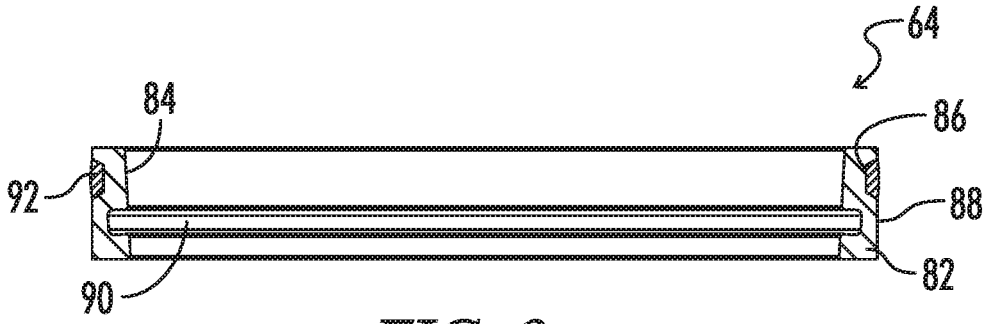
FIG. 9 is an enlarged elevation section view of the sealing ring of the plug assembly.

The details of construction of the sealing ring 64 are best seen in FIG. 9. The sealing ring 64 includes an annular ring body 82 having a tapered ring bore 84 complementary to the tapered outer surface 78 of annular wedge 62. The ring body 82 is constructed of a sufficiently ductile material to allow the ring body 82 to radially expand as the wedge 62 is forced axially into the slip 66 and the slip 66 pushes the sealing ring axially along the tapered outer surface 78 of wedge 62 toward the wedge first end 68. The sealing ring body 82 may for example be constructed of aluminum.

The sealing ring body 82 has an annular outer groove 86 defined in a radially outer surface 88 of the ring body 82. An annular inner groove 90 is defined in the ring bore 84. The groove 86 and 90 are each filled with an elastomeric seal material. Thus, an outer elastomeric seal 92 is shown in FIG. 9. It will be understood that a similar inner elastomeric seal 94 (see FIG. 4) will fill the inner groove 90. The elastomeric seals 92 and 94 may be molded in place in the grooves 86 and 90.

Figure 10:
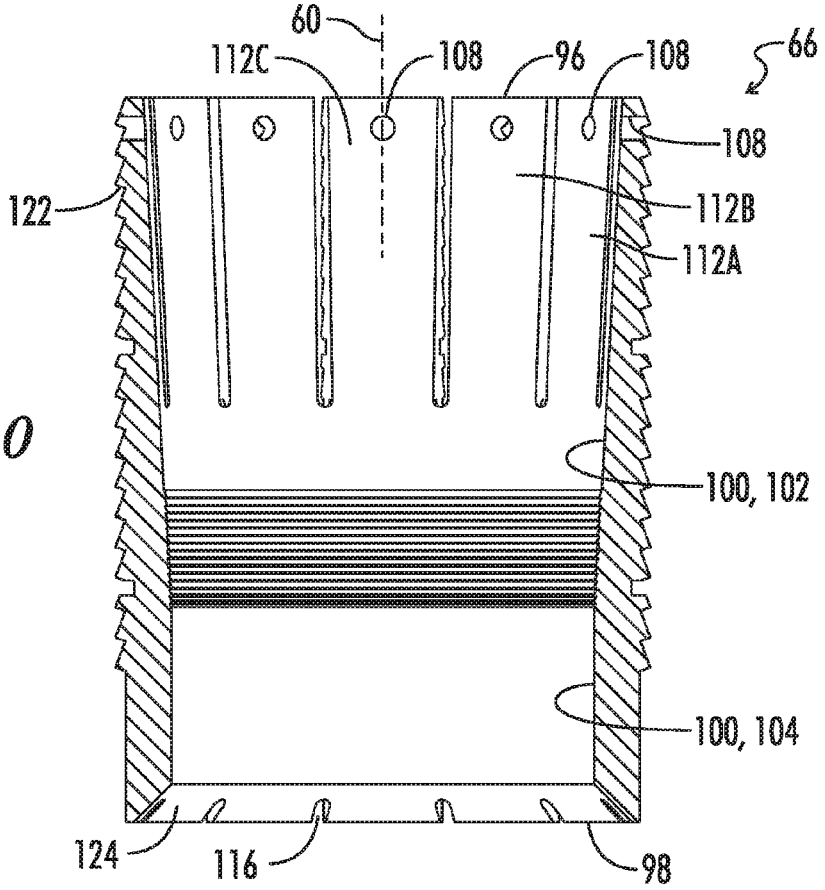
FIG. 10 is an enlarged elevation section view of the annular slip of the plug assembly.
Figure 11:
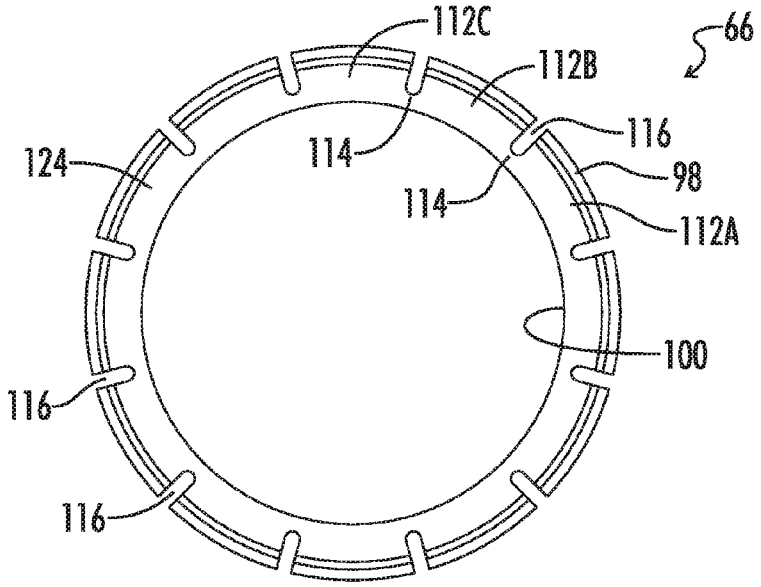
FIG. 11 is bottom view of the slip of FIG. 10.

The annular slip 66 is best seen in the lower part of FIG. 4 and in FIGS. 10 and 11. Slip 66 has a slip first end or upper end 96 and a slip second end or lower end 98. An axial slip passage or slip bore 100 extends through slip 66 from the first end 96 to the second end 98. The slip passage 100 has a tapered inner surface 102 adjacent the slip first end 96. The tapered inner surface 102 decreases in diameter from the slip first end 96 toward the slip second end 98. It is noted that the tapered inner surface 102 terminates at an intermediate point and the lower portion 104 of slip passage 100 may be a straight cylindrical passage.

As seen in FIG. 4, the lower end of the annular wedge 72 is received in the upper end of the slip 66 so that the tapered outer surface 78 of wedge 62 engages the tapered inner surface 102 of the slip 66. Also, in the initial positions such as shown in FIG. 4, the upper end 96 of the slip 66 faces and abuts the sealing ring 64.

In the initial position shown in FIG. 4, a plurality of shear pins 106A and 106B extend through radial bores 108 near the upper end of slip 66 and are received in a groove 110 defined in the tapered outer surface 78 of wedge 62. Shear pins 106A and 106B may for example be made of brass or aluminum. Preferably there is one such shear pin 106 in each of the slip segments 112 discussed below. The shear pins such as 106A and 106B may be generally referred to as a frangible retainer 106 initially connecting the wedge 62 and the slip 66 to retain the wedge 62 in the initial position shown in FIG. 4 relative to the slip 66. In this initial position the slip 66 and the sealing ring 64 are in an unset configuration.

Figure 6:
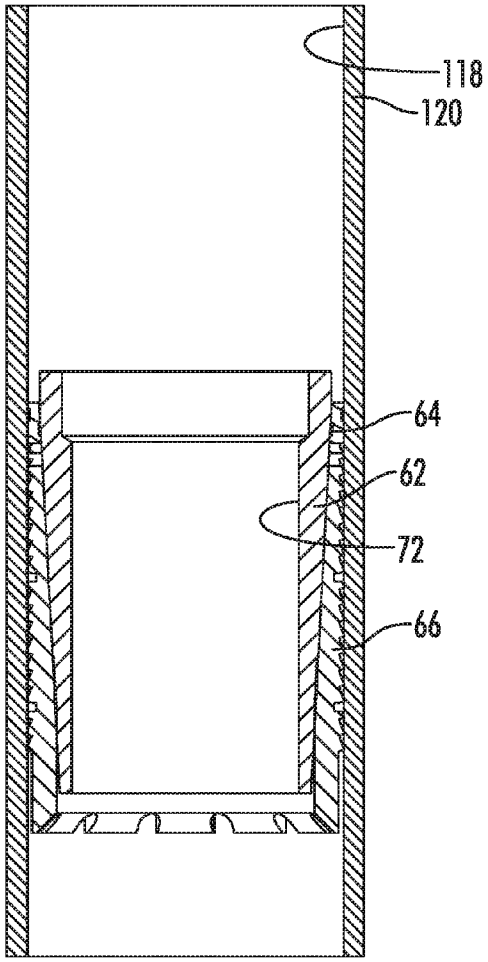

The details of construction of the annular slip 66 are best seen in FIGS. 10 and 11. The slip 66 includes a plurality of slip segments such as 112A, 1126, 112C, etc. The slip segments 112 are arranged circumferentially relative to the tool string axis 60 and extend lengthwise from the first or upper end 96 to the second or lower end 98. The slip 66 is of the type known as a breakaway slip, wherein the slip segments 112 are initially joined together by frangible portions 114. As best seen in FIG. 11, in its initial form prior to setting, the slip 66 is an integrally formed construction wherein the slip segments such as 112A and 112B are separated by longitudinal grooves such as 116 which create the frangible portions or webs 114 joining adjacent slip segments. When the wedge 62 is driven downward into the slip 66 as can be appreciated in comparing FIGS. 5 and 6, the wedge 62 forces the slip segments 112 radially outward such that at least some of the frangible portions 114 break apart thus allowing the individual slip segments such as 112A and 112B to move radially outward into anchoring engagement with the casing bore 118 of the well casing 120 such as schematically illustrated in FIGS. 6 and 7.

Each of the slip segments has a majority of its length covered with downward facing serrations or teeth 122 for engagement with the casing bore 118. The lower end 98 of the slip 66 preferably has an inwardly tapered inner surface 124 formed at an angle complementary to the upward facing setting surface portions 58 defined on the collet heads 38. Thus, as will be further described below, when the collet sleeve 32 is pulled upward after setting of the slip assembly 16, the engagement of tapered surface 124 with the upward facing setting surface portions 58 will cause the collet heads 38 to be cammed radially inward.

Methods of Assembly

The adapter kit apparatus 14 and the plug assembly 16 may be assembled with the setting tool 12 in generally the following manner.

First, an inner assembly of the adapter kit apparatus is assembled by inserting the inner mandrel 22 upwards through the collet sleeve 32 and then attaching the top cap 124 to the upper end of the inner mandrel 22 via a threaded connection 126 therebetween. One or more set screws 128 may be used to secure the threaded connection between inner mandrel 122 and top cap 24. The desired number of shear pins 48 may be installed into axial bores 50 of collet sleeve 32 and into engagement with the groove 46 of mandrel 42.

The inner assembly of the adapter kit apparatus can then be inserted into the bore of plug assembly 16 to such point that upward facing setting surface portions 58 of collet heads 38 are in contact with mating surface 124 of slip 16.

Next, the adjusting sleeve 54 may be threadedly connected to the lower end of setting tool outer part 20 at threaded connection 130. If one or more set screws (not shown) may be utilized to secure the threaded connection 130.

The setting tool adapter 26 may then be connected to the lower end of setting tool inner part 18 at threaded connection 132, and one or more set screws (not shown) may be used to secure the threaded connection 132.

Then, the setting sleeve 52 is threaded onto the adjusting sleeve 54. The adjusting sleeve 54 and setting sleeve 52 are configured so that a threaded connection 134 therebetween may be completely overrun by the setting sleeve 52 thus allowing the setting sleeve 52 to freely slide upwardly past the adjusting sleeve 54, thus allowing access to the setting tool adapter 26 which has already been connected to the setting tool inner part 18.

Figure 17:
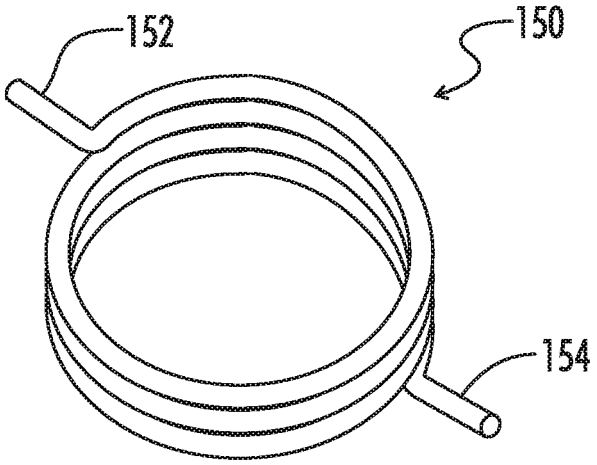
FIG. 17 is a perspective view of a tension mandrel lock spring.

Then, the inner assembly of the adapter kit apparatus made up of the inner mandrel 22, release sleeve 32 and top cap 24 can be connected to the setting tool adapter 26 by a threaded connection 136 between top cap 24 and setting tool adapter 26. Again, one or more set screws (not shown) may be utilized to secure the threaded connection. FIG. 17 shows a perspective view of a tension mandrel lock spring 150 which may be used to maintain the connection between the top cap 24 and the setting tool adapter 26. The tension mandrel lock spring 150 is schematically illustrated in FIG. 3 and it includes upper and lower end prongs 152 and 154 which may engage radial recesses (not shown) in the lower end of setting tool adapter 26 and in the upward facing shoulder of top cap 24, to prevent relative rotational motion between top cap 24 and setting tool adapter 26 after assembly thereof.

Then, the outer setting sleeve 52 may be slid back downward relative to the adjusting sleeve 54, and the threaded connection 134 therebetween may then be made up to adjust the position of the setting sleeve 52 downward until its lower end 56 engages the upper end 68 of the annular wedge 62.

At this point the apparatus is in the position shown in FIG. 4 and it is ready to be run down into the well bore.

It is noted that in this initial assembled arrangement as seen in FIG. 4, an outside diameter of the wedge 62 at its upper cylindrical outer surface portion 80 is substantially equal to an outside diameter defined by the collet heads 38 between their radially outer most surfaces 138, so that surfaces 80 and 138 can serve as gauge points which will support the assembly against the inner casing bore 118 as the tool that runs down into the well. It is noted that the sealing ring 64 and the annular slip 66 in their initial orientation have outside diameters less than the outside diameters at the gauge points 80 and 138, thus protecting the sealing ring 64 and the slip 66 from engagement with the casing bore 118 as the tool is run into the well bore. This is particularly important, for example, when running the tool string through horizontally oriented portions of the casing 120.

Methods of Operation

With the adapter kit apparatus 14 and plug assembly 16 in their initial orientation as shown in FIG. 4, the tool string is ready to be run down into the well bore. As previously noted the tool string may be run into the well bore on a wireline or by other suitable means, which downward motion may be assisted by pumping well fluid downward through the well bore to carry the tool string to its desired location.

FIGS. 12-15 sequentially illustrate the subsequent steps by which the plug assembly 16 is set within the well casing 120. Reference is also made to the sequential steps illustrated in FIGS. 5-7 which show the plug assembly 16 in various positions as it is set in the casing bore 118.

Thus, with the tool string in the arrangement generally shown in FIG. 4 it is lowered and or pumped down into the well to the desired location where the plug assembly 16 is to be set within the casing bore 118 of well casing 120. In the orientation of FIG. 4, it is seen that the plug assembly 16 made up of the annular wedge 62, the annular slip 66 and the sealing ring 64 is held between the downward facing setting surface 56 and the upward facing setting surface portions 58. A subsequent downward movement of the outer setting sleeve 52 relative to the inner mandrel 22 will cause axial compression of the plug assembly 16 driving the annular wedge 62 downward into the annular slip 66 thus radially expanding the slip 66 to anchor the slip 66 against the casing bore 118, and also radially expanding the sealing ring 64.

Upon expansion of the sealing ring 64, the outer elastomeric seal 92 seals against the casing bore 118 and the inner elastomeric seal 94 seals against the tapered outer surface 78 of annular wedge 62. There also can be a metal to metal seal between the ring body 82 and both the casing bore 118 and the wedge 62.

Figure 12:
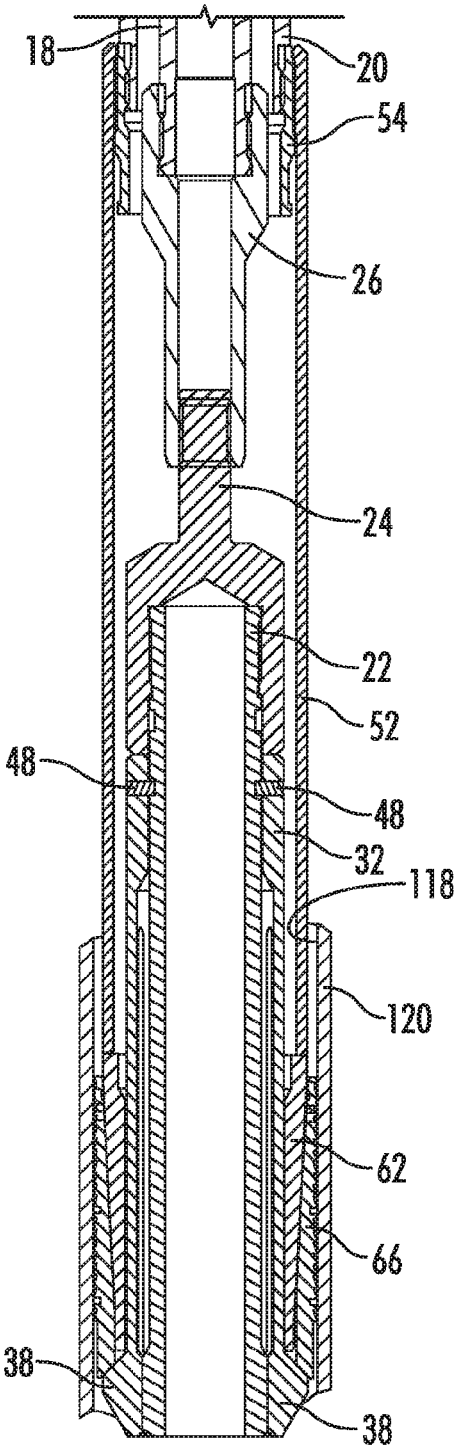
FIGS. 12-15 comprise a sequential series of views showing the operation of the adapter kit apparatus and the plug assembly to set the plug assembly in the well and to then release the adapter kit apparatus from the plug assembly.

FIG. 12 shows the slip assembly 16 immediately after this downward compression has occurred but before the shear pins 48 have sheared.

It will be understood that the downward motion of outer setting sleeve 52 relative to inner mandrel 22 will occur due to the actuating motion of the setting tool 12 in which the setting tool outer part 20 moves downward relative to the setting tool inner part 18.

During the downward motion of the outer setting sleeve 52 relative to inner mandrel 22 the compressive force is transmitted longitudinally through the plug assembly 16 against the upward facing setting surface portions 58 of the collet heads 38, thus exerting that same downward force on the collet sleeve 32 relative to the inner mandrel 22. The inner mandrel 22 may be thought of as being held fixed or as being pulled upward relative to the outer setting sleeve 52 which may be moving relatively downward.

Figure 13:
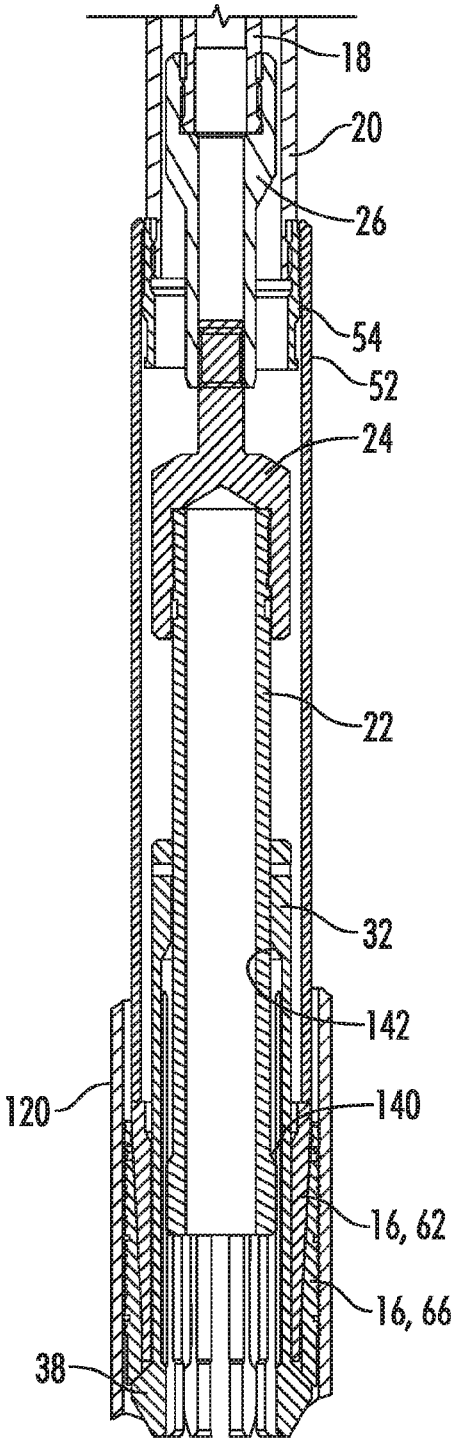

As the annular wedge 62 is driven into the annular slip 66, the force required for further axial motion therebetween will continually increase. At the point that the downward force being exerted on the collet sleeve 32 exceeds the shear strength of the plurality of shear pins 48, the shear pins 48 will shear and then the inner mandrel 22 will begin to move upward relative to the collet sleeve 32 as can be appreciated by comparing FIG. 13 to FIG. 12. In FIG. 13, the shear pins 48 have sheared and the relative upward movement of inner mandrel 22 relative to collet sleeve has begun. The collet sleeve 32 cannot yet move upward relative to plug assembly 16 because of the engagement of the collet heads 38 with the lower end of annular slip 66.

The number, size, and materials of construction of the shear pins 48 determine the predetermined value of the compressive force which can be applied to the slip assembly 16 by the setting tool 12 and adapter kit apparatus 14. One that predetermined force is exceeded, the shear pins 48 will shear so that no further compression is applied to the plug assembly 16, and so that the adapter kit apparatus 14 is released from the plug assembly 16.

Figure 14:
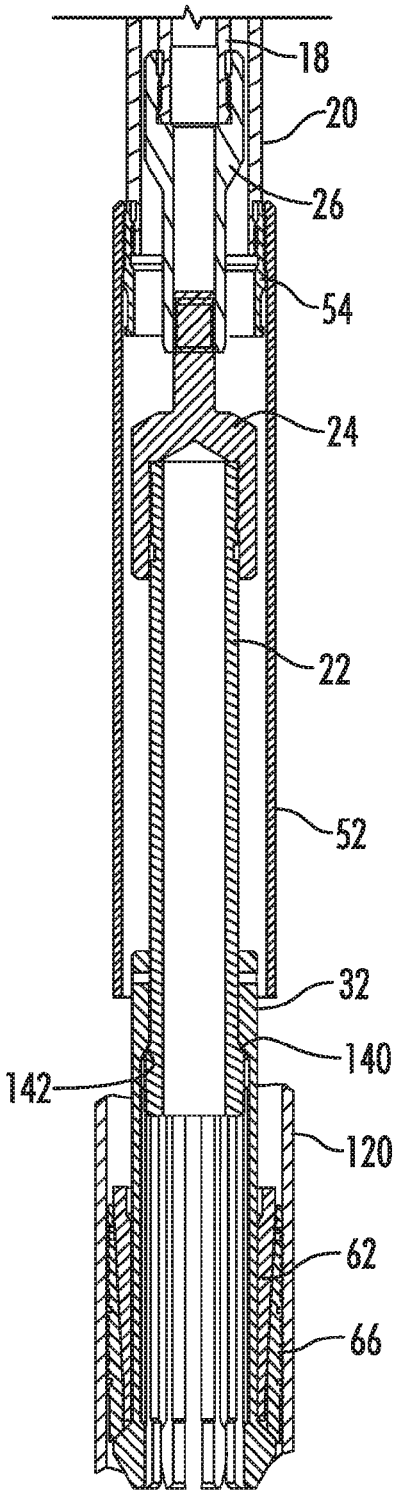

The upward motion of the inner mandrel 22 relative to collet sleeve 32 will continue until the position of FIG. 14 is reached at which point an upward facing shoulder 140 defined on the inner mandrel 22 engages a downward facing shoulder 142 defined on the inside of the collet sleeve 32.

Figure 15:
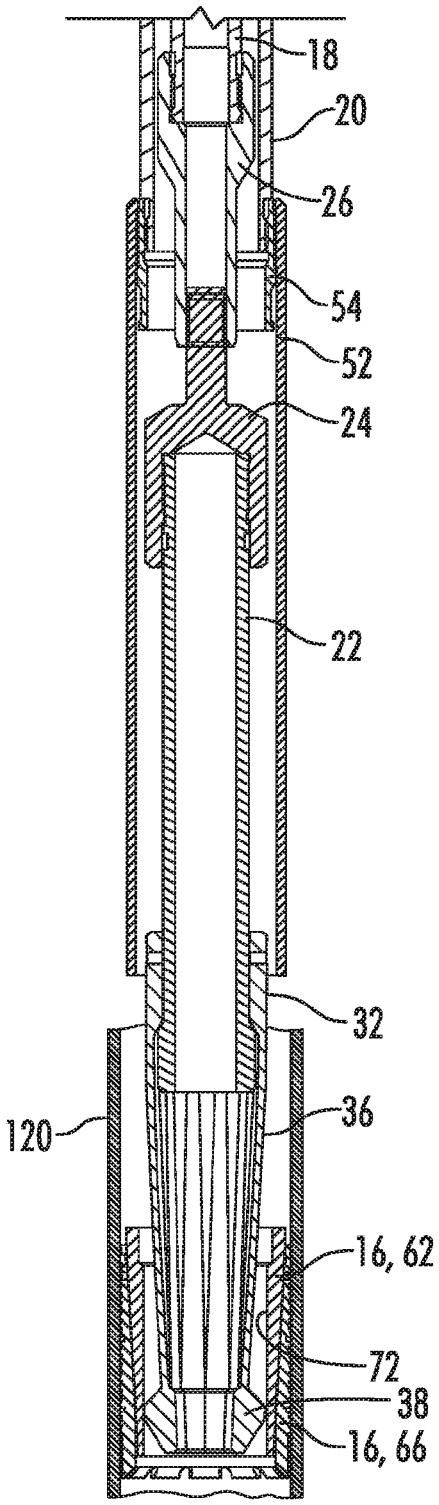

Then, continued upward motion of the setting tool 12 and the adapter kit apparatus 14 relative to the plug assembly 16 causes the collet arms 36 and collet heads 38 to be biased radially inwardly and the collet heads 38 may then be pulled upward through the inner bore 72 of the annular wedge 62. In FIG. 15, the collet sleeve has been partially pulled through the annular wedge 62. Continued upward motion of the tool string will pull the collet sleeve 32 and particularly the heads 38 thereof completely upward through the plug assembly 16 and out of engagement therewith.

The method of setting the frac plug 16 in the casing bore 118 may be described as including the steps of:

(a) initially retaining the wedge 62 and the slip 66 in an unset position as shown in FIG. 5 with the lower tapered outer surface 78 of the wedge received in the upper tapered inner surface of the slip 66, and with the sealing ring 64 received about the wedge 62 above the slip 66 and engaged with the upper end 96 of the slip 66;

(b) while the plug assembly 16 is retained in the unset position of FIG. 5, running the plug assembly 16 into the well casing 120 to a casing location to be plugged; and (c) setting the plug assembly 16 in the casing 120 by forcing the angular wedge 62 axially into the annular slip 66 and the sealing ring 64, thereby:

(c)(1) radially expanding the slip 66 to anchor the plug assembly 16 in the casing 120; and (c)(2) radially expanding the sealing ring 64 to seal the plug assembly 16 against the casing 120.

Alternatively, the methods of setting the plug assembly 16 in the casing bore 18 may be described as including the steps of:

(a) connecting the plug assembly 16 in an initial arrangement with the setting tool 12 using the adapter kit 14, the initial arrangement including:

the plug assembly 16 including the plug wedge 62 in an initial position partially received in the plug slip 66, with the sealing ring 64 received around the wedge 62 adjacent an upper end of the slip 66 as shown for example in FIG. 5;

the plug wedge 62 and the plug slip 66 being received about an inner part 22, 32 of the adapter kit apparatus 14, with the upward facing setting surface portions 58 of that inner part facing the lower end 98, 124 of the plug assembly 16; and an outer part of the adapter kit apparatus 14 including the outer setting sleeve 52 having a downward facing setting surface 56 facing the upper end 68 of the plug assembly 16;

(b) running the plug assembly 16, the adapter kit 14 and the setting tool 12 into the casing bore in the initial arrangement;

(c) setting the plug assembly 16 in the casing bore by actuating the setting tool 12 and compressing the plug assembly 16 between the upward facing setting surface portions 58 and the downward facing setting surface 56 as generally illustrated in FIG. 12; and (d) releasing the plug assembly 16 from the adapter kit apparatus 14 as described above with reference to FIGS. 12-15.

It will be noted that when the adapter kit apparatus is removed from the plug assembly 16 so that the plug assembly 16 is left in place in the well bore as shown in FIG. 6, the inner bore 72 of the annular wedge 62 is free of any flow restricting structures.

After setting of the plug assembly 16 in the casing bore, the setting tool 12, and adapter kit apparatus kit 14 and the wireline to which they are attached will typically be retracted to another point higher in the well where perforating guns will be fired to pierce the well casing and to allow communication of a subterranean formation with the casing bore 168.

All of the wireline tools may then be removed from the well bore and the frac ball 76 may be pumped down into the well bore until it lands on the seat 74 of the plug assembly 16. The plug assembly 16 with the frac ball 76 seated thereon then serves to isolate the areas or zones of the well below the plug assembly 16 from the perforated well bore portion above the plug assembly 16.

Once isolation is established a frac stage is typically pumped wherein particulate laden fluids are pumped into the well bore under pressure and out through the perforations into the sub surface formation to fracture the same.

After a first frac stage, another plug assembly 16 may be running to the well in a manner similar to that described above, and another frac stage may be performed. The process is continued until all desired frac stages are finished.

Prior to production of the well, the plug assemblies 16 are typically drilled out of the well bore. This process may be accomplished utilizing coil tubing, drilling motors and either mills or bits. The coil tubing is run into the well bore with a motor and bit, the plugs are drilled up from top to bottom of the well bore while the plug debris is circulated back out with the well fluid flow. Coil tubing drill outs typically cost $100,000.00 per day and typical prior art drill out project time can be 2-3 days. The plug assembly 16 disclosed herein may substantially reduce the drill up time and this translates directly to savings in cost.

Alternatively, the frac ball 76 shown in FIG. 7 may be a dissolvable frac ball. Such a dissolvable frac ball 76 would then dissolve slowly over time (1-14 days) and subsequently allow the operator to produce the well through the internal diameter of the plug assembly 16. This method could further reduce the completion cost by eliminating the drill up cost all together.

Optional Pump Down Fin Feature

Figure 16:
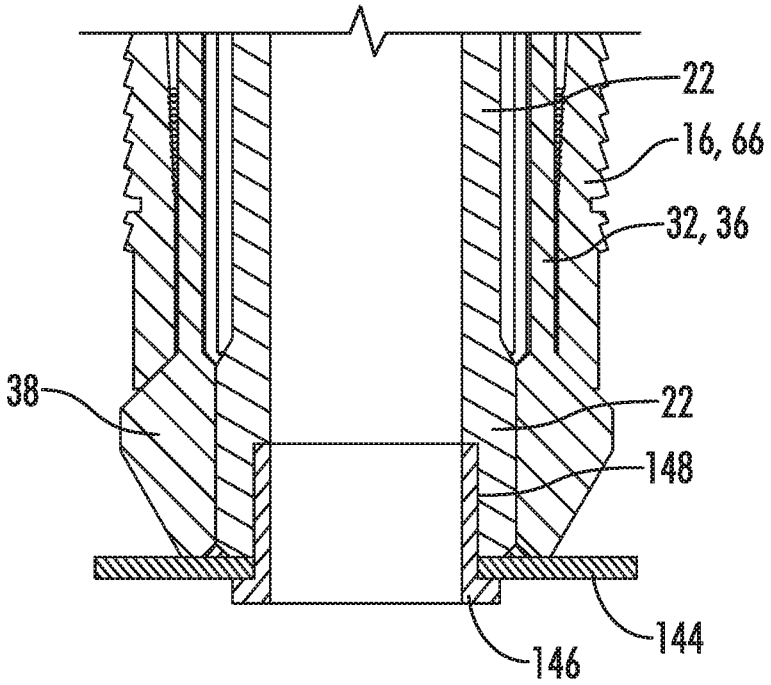
FIG. 16 is an elevation section view of the lower end of the adapter kit apparatus of FIG. 4 showing an optional feature of a pump down fin connected to the adapter kit apparatus.

In FIG. 16, a view is seen similar to the lower end of FIG. 4, showing an optional construction of the adapter kit apparatus wherein a rubber or elastomeric pump down fin 144 is attached to the lower end of inner mandrel 22 with an annular nut 146 connected to inner mandrel 22 at threaded connection 148.

FIG. 16 corresponds to the arrangement shown in FIG. 4 wherein the plug assembly is in place on the adapter kit apparatus 14 and is ready to be run down into the well. It will be appreciated that the elastomeric fin 144, when in the orientation shown in FIG. 16, can slidingly sealingly engage the casing bore 118 in a flexible manner and will aid in the pumping of the tool string down into the well.

However, when the adapter kit apparatus 14 is disengaged from the plug assembly 16 in the manner just described above with reference to FIGS. 12-15, it will be appreciated that as the inner mandrel 22 pulls upward through the collet sleeve 32, the elastomeric pump down fin 144 will be deformed and will also be pulled upward within the collet sleeve 32 so that the pump down fin 144 does not impede the retrieval of the tool from the well bore.

Materials of Construction

The plug assembly 16, and particularly the annular wedge 62 and the annular slip 66 thereof might be made of any suitable materials such as are known for use in such plug assemblies.

In one preferred embodiment the wedge 62 and slip 66 may be constructed of non-metallic materials which are easily drilled out of the well bore for subsequent removal of the slip assembly from the well bore.

Additionally, the ball utilized with the plug assembly 16, such as the ball 76 shown in FIG. 7 may be made out of dissolvable material.

The plug assembly 16 may also be made of metallic materials if desired. The slip 66, for example, may be constructed of surface hardened cast iron, wherein the surface has a hardness in a range of 50-60 Rockwell C.

Advantages

Many advantages are provided by the methods and apparatus described above. The frac plug assembly 16 disclosed provides a much larger internal diameter of the bore 72 of annular wedge 62 than do comparable prior art products constructed for use in similar size well casings. Similarly the overall length of the plug assembly 16 is much less than comparable prior art products designed for use in similar size well casings, because of the much more simple construction of the plug assembly 16.

It is noted that in the plug assembly 16, the annular wedge 62 replaces several components of typical frac plugs which typically have a central mandrel about which a cone is slidably received. The plug assembly 16 disclosed herein has only three components, namely the annular wedge 62, the sealing ring 64 and the annular slip 66. That is compared to typical prior art bridge plug or frac plug assemblies which may have many more individual components and take up much more space in the well bore.

With the plug assembly 16 in which the typical plug assembly mandrel of the prior art is eliminated all-together, the plug assembly 16 can be made to have a much larger internal diameter and much shorter overall length while achieving the same task as prior art plugs. The larger internal diameter and shorter length correlate directly to less overall tool volume. For tools made of drillable materials, this correlates directly to much faster drill out times.

For example, axial wedge passage 72 may have a minimum inside diameter at least 30% of an overall length of the plug assembly 16 from the upper end of the wedge 62 to the lower end of the slip 66 when the plug assembly is in an unset position as shown in FIG. 4.

The axial wedge passage 72 may have a minimum inside diameter at least 50% of an overall length of the plug assembly 16 from the upper end of the wedge 62 to the lower end of the slip 66 when the apparatus is in the set position as shown in FIG. 6.

The axial wedge passage 72 may have a minimum inside diameter at least 75% of an outside diameter of the slip 66 when the apparatus is in the set position as shown in FIG. 6.

Alternative Embodiment

Figure 18A:
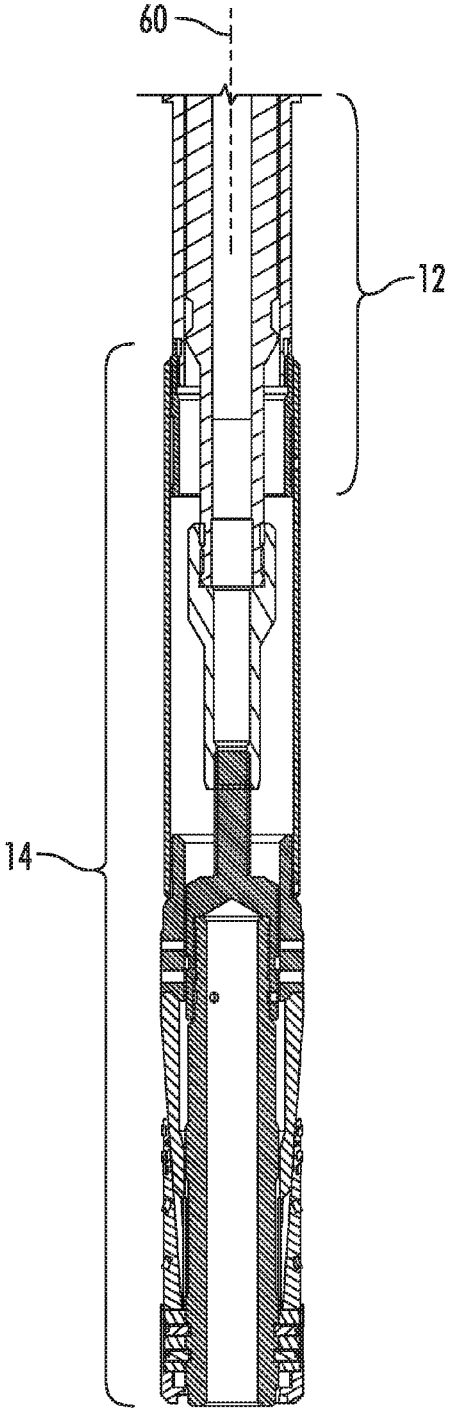
FIG. 18A is an elevation section view of an alternative embodiment of a tool string including a setting tool, an adapter kit apparatus, and a plug assembly according to the present invention.
Figure 18B:
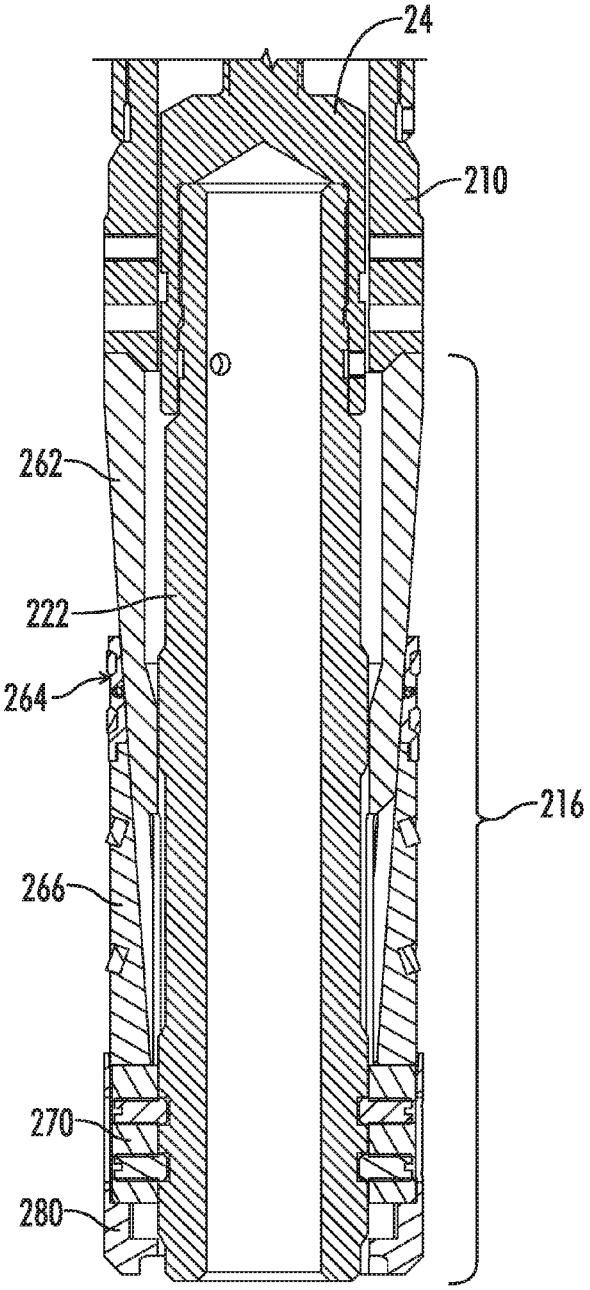
FIG. 18B is an expanded elevation section view of an alternative embodiment of a tool string including an adapter kit apparatus, and a plug assembly according to the present invention.

According to an alternative embodiment shown in FIGS. 18A-18B, a tool string includes a setting tool 12, adapter kit 14 and an alternative plug assembly 216. The alternative plug assembly 216 couples to the adapter kit 14 via an actuating mandrel 222 and a sleeve adapter 210. For convenience, the end of the plug 216 assembly conventionally mounted closest to the setting tool 12 can be referenced as the up-hole, or upper end, while the opposite end of the plug assembly 216 can be referenced as the downward or down-hole end. Plug assembly may use additional adapters, such as top cap 24, to connect mandrel 222 and sleeve adapter 210 to the setting tool 12. Preferably, the setting tool 12, the adapter kit 14 and an alternative plug assembly 216 share substantially the same center line or longitudinal axis 60. Alternative plug assembly 216 includes annular wedge 262, seal ring 264, annular slip 266, setting ring 270 and gauge ring 280.

Figure 19:
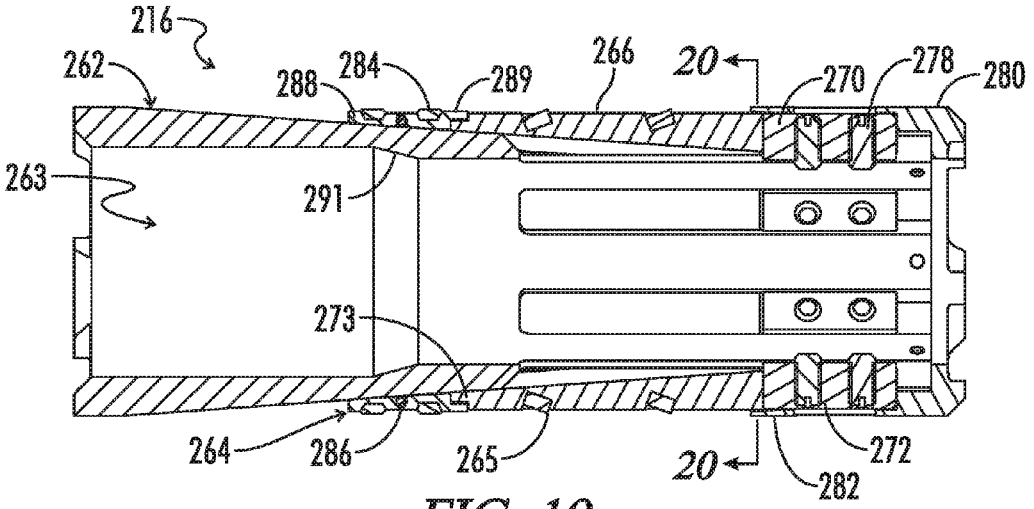
FIG. 19 is an expanded section view of the plug assembly of FIG. 18B.
Figure 21:
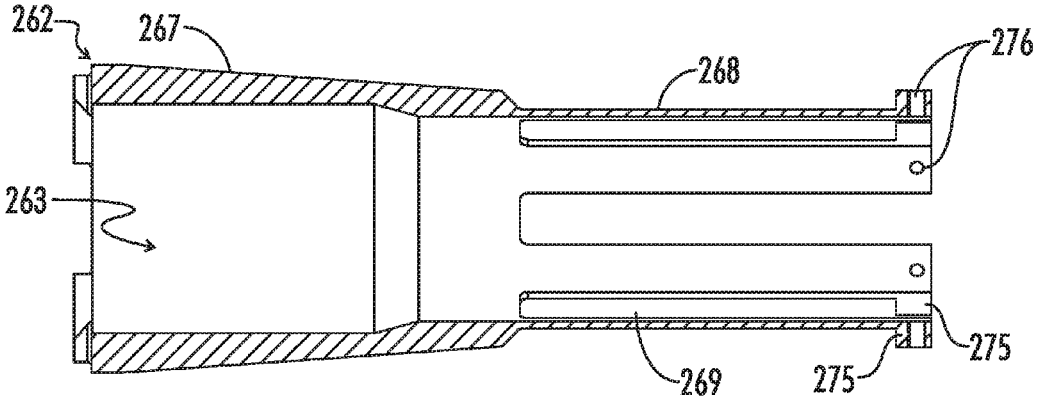
FIG. 21 is an expanded section view of the annular wedge shown in FIG. 19.

FIG. 19 shows an additional view of the alternative plug assembly 216. Annular wedge 262 surrounds a bore or passage 263 and has an external generally conical surface 267 that tapers in a downward direction to a smaller diameter, as shown in FIG. 21. The conical surface 267 can optionally extend to the upper end of the wedge 262, or can meet a non-tapered cylindrical surface near the upper end of the wedge 262. Integrally formed with wedge 262 is a plurality of collet fingers 268 that extend axially from the lower end of the conical surface 267 of wedge 262. Annular wedge 262 includes a bore 263 that extends through the wedge 262 to form an axial passage.

A sealing ring 264 is disposed on the conical surface 267 and surrounds wedge 262. Sealing ring 264 includes an annular ring body 288 having a tapered bore complementary to the tapered outer surface 267 of annular wedge 262. The ring is constructed of a sufficiently ductile material to allow the ring body 288 to radially expand as the wedge 262 is forced axially into the slip 266 and the slip 266 pushes the sealing ring 264 axially along the tapered outer surface 267 of wedge 262. Sealing ring body 288 may, for example, be constructed of aluminum. Sealing ring 264 can further include one or more outer elastomeric seals 284 in corresponding grooves on the sealing ring's outer surface and can also include one or more inner elastomeric seals 286 in corresponding grooves on the sealing ring's inner surface. Outer elastomeric seals 284 and inner elastomeric seals 286 respectively facilitate a fluid tight seal between sealing ring 264 and annular wedge 262 and also between sealing ring 264 and casing once the plug 216 has been set in a well. Sealing ring body 288 can further include a downward facing end that forms a lip 289 to engage with, and help locate, an upward facing end surface, slip lip 273, of annular slip 266.

Figure 20:
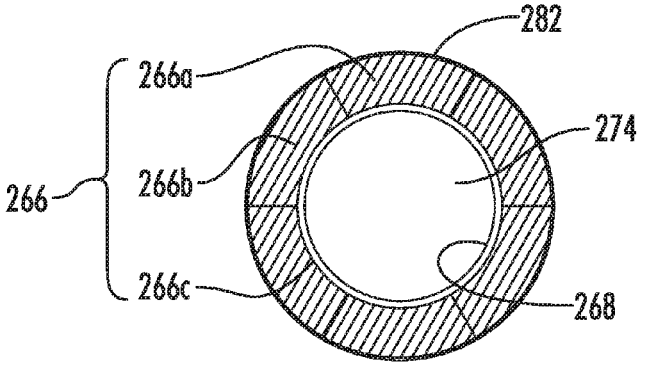
FIG. 20 is a cross section A-A view of the plug assembly of FIG. 19.

Annular slip 266 can be formed from a number of separate slip segments, such as segments 266*a*, 266*b*, 266*c*, that are arranged annularly. As shown in FIGS. 19 and 20, when plug assembly 216 is in an unset position, the slip segments are adjacent one another, preferably abutting, to include an axial inner passage or bore 274 that extends through annular slip 266. Annular slip 266 has an inner, generally conical surface that tapers in a downwards direction to a smaller diameter and engages with the complementary outer surface 267 of wedge 262 which extends into the slip bore 274. Upward facing end surface of slip 266, slip lip 273, can help to secure the top end of the slip segments, including segments 266*a*, 266*b*, 266*c*, so that slip's inner surface remains engaged with wedge outer surface 274 while in use. Annular slip 266 can include high-strength or hardened particles, grit or inserts, such as button 265 embedded in its outer surface to promote grip between slip 266 and casing, once plug 216 has been set. Button 265 can be, for example, a ceramic material containing aluminum, such as a fused alumina or sintered bauxite or other fused or sintered high-strength material, or a carbide such as tungsten carbide.

Collet fingers 268 are circumferentially spaced around the annular wedge 262 to form a slot 269 between each pair of collet fingers 268. Collet fingers 268 extend downward through the slip's axial passage 274 and terminate beyond the lower end of the slip annular 266. Each collet finger 268 can terminate with a collet head 275 having a radial head hole 276 to which gauge ring 280 can be secured.

Figure 22A:
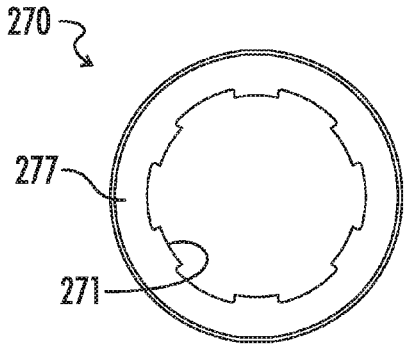
FIGS. 22A-22B comprise an elevation and a cross section view, respectively, of the setting ring shown in FIG. 19
Figure 22B:
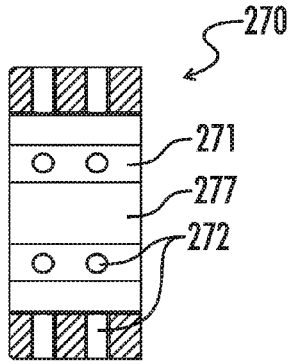
Figure 26A:
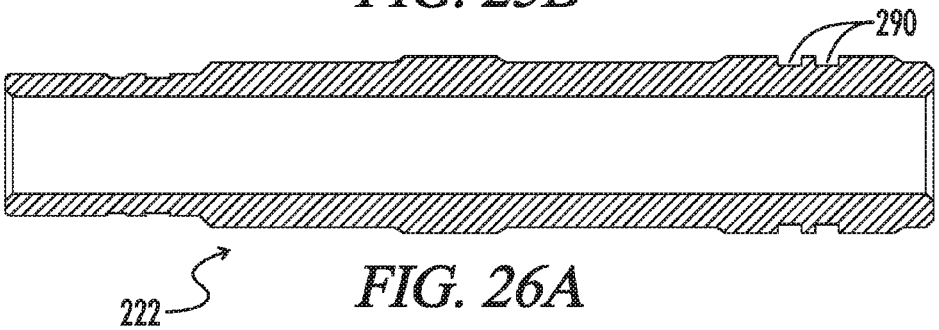
FIG. 26A is an expanded section view of an actuating mandrel according to an alternative embodiment of the present invention.

Setting ring 270 is adjacent the downward facing end of slip 266 and includes a ring body 277 and keys 271 that protrude radially inwardly from the setting ring body 277, as shown in FIG. 22A. Keys 271 are circumferentially spaced to correspond with and extend into slots 269 between collet fingers 268. The setting ring is slidably mounted on collet fingers 268 so that the upward facing surface of the setting ring 270 preferably abuts downward facing surfaces of slip 266. As shown in FIG. 22B, keys 271 can include through holes 272 through which frangible fasters 278 can attach the setting ring 270 to actuating mandrel 222. Frangible fasters 278 can be shear screws designed to break at a desired shear force and allow actuating mandrel 222 to separate from the setting ring 270 after plug 216 has been set in a well. Through holes 272 can be threaded to receive shear screws 278. As shown in FIG. 26A, actuating mandrel 222 can include grooves 290 or a similar recess into which fasteners 278 can extend to attach the setting ring 270 to the actuating mandrel 222.

Figure 23A:
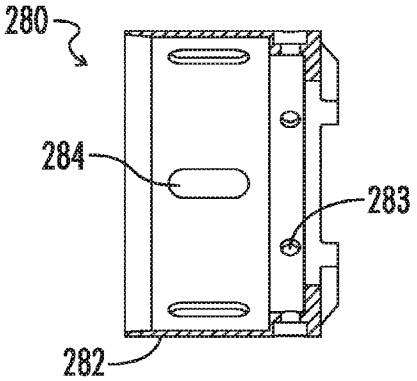
FIGS. 23A-23B comprise a side and an bottom elevation view, respectively, of the gauge ring shown in FIG. 19
Figure 23B:
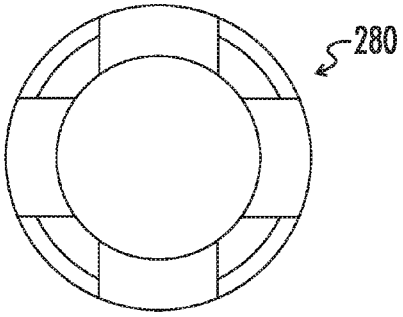
Figure 24:
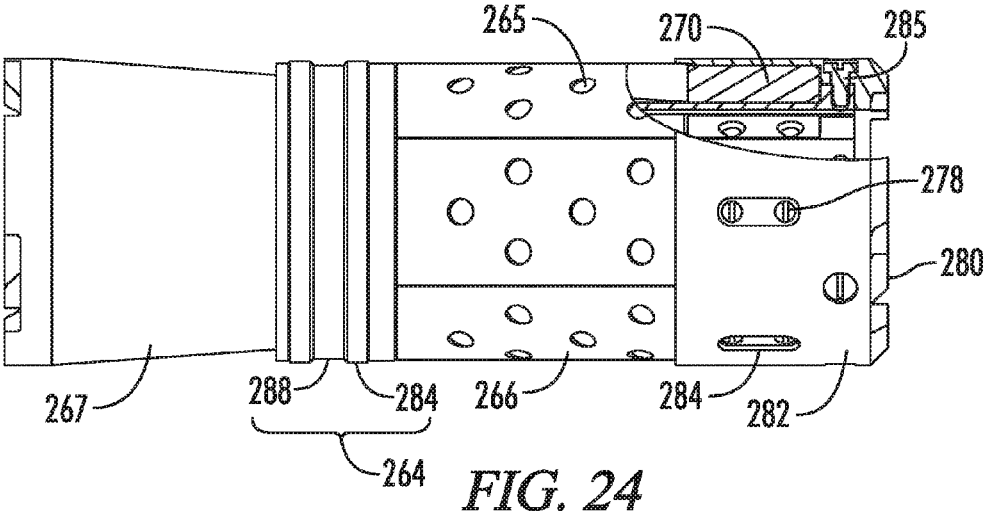
FIG. 24 is a cut-away elevation view of the plug assembly of FIG. 19.
Figure 25A:
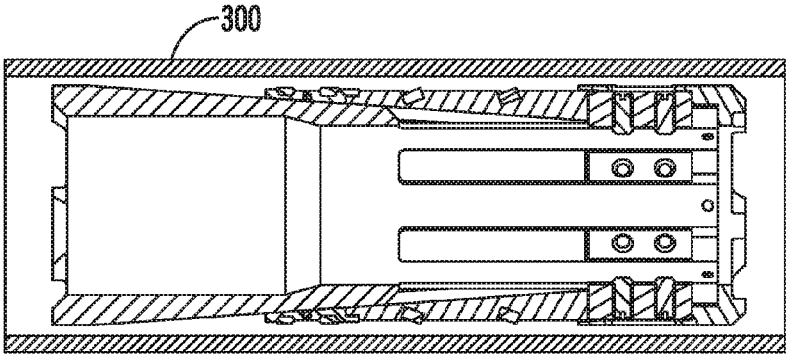
FIG. 25A is an expanded section view of the plug assembly of FIG. 19 shown in well casing in an unset condition.

Gauge ring 280 can be attached at the end of collet fingers 268. Gauge ring 280 can be secured to the collet fingers 268 by any suitable means of attachment, such as by fastener 285, shown in FIG. 24. Fastener 285 can include screws, bolts or pins inserted into radial through holes 283 (shown in FIG. 23A) in a sidewall of the gauge ring 280 and into collet head holes 276. With plug 216 in an unset condition, as shown in FIGS. 25A and 19, setting ring 270 is located adjacent to the gauge ring 280 and also adjacent annular slip 266. The outer diameter of gauge ring 280 is preferably greater than the outer diameter of setting ring 270. Gauge ring 280 can include perimeter wall 282 which surrounds setting ring 270 and extends axially to a lower end of slip 266. To facilitate attaching setting ring 270 to actuating mandrel 222, perimeter wall 282 of gauge ring 280 can include opening 284 to allow alignment of slots 269, setting ring through holes 272 and grooves 290, and the insertion of frangible fasteners 278. FIG. 23B shows a bottom view of the gauge ring 280.

Gauge ring 280 can protect the downward end of the plug 216 as it is lowered into a well. Casing in a well may not have a uniform diameter and can have protrusions resulting from, for example, accumulation of debris, scale, and rust, or from dents, bends, manufacturing defects and other damage to the casing itself. Moreover, well fluids can contain solids and debris that can impede the movement of some large tools in the well. Tolerances between plug 216 an casing can be relatively small, leaving only a small gap for the flow of well fluids and debris between the plug and casing as the plug 216 is lowered into a well. Thus plug 216 can be susceptible to becoming stuck on protrusions or debris as it is lowered into position in a well. Having a diameter that is preferably greater than the setting ring 270 and, more preferably, greater than the diameter of the remainder of the plug 216, gauge ring 280 presents a leading edge that prevents the plug 216 from being lowered into constrictions in the well bore that are too narrow for the plug to pass. Gauge ring 280 preferably also provides sufficient tolerance for plug 216 to be lowered past obstructions, protrusions and bends in the casing that could catch against the sides of the plug. Moreover, by including perimeter wall 266 that extends around setting ring 270 to the lower portions of slip 266, gauge ring 280 can hold the lower portions of slip segments in a close annular arrangement, and can also protect the setting ring 270 and slip 266 from catching on protrusions or debris that might cause slip 266 to partially deploy and plug 216 to prematurely set.

Figure 25B:
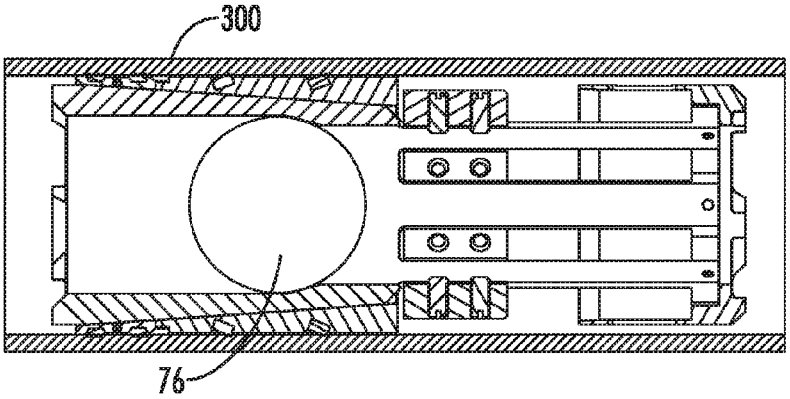
FIG. 25B is an expanded section view of the plug assembly of FIG. 19 shown in well casing in a set condition.
Figure 26B:
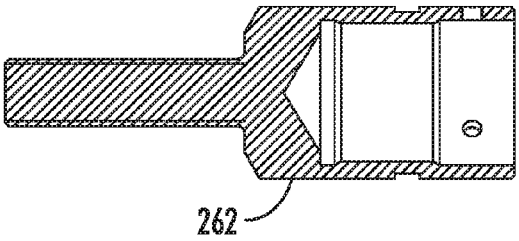
FIG. 26B is an expanded section view of a top cap according to an alternative embodiment of the present invention.
Figure 26C:
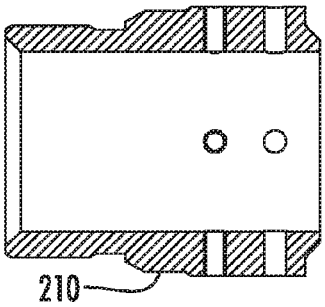
FIG. 26C is an expanded section view of a sleeve adapter according to an alternative embodiment of the present invention.

FIG. 25B shows an example of plug 216 set within casing 300. To set plug 216, the plug 216 can be coupled to setting tool 12 via actuating mandrel 222 which is releasably coupled to setting ring 270 using frangible fastener 278 while the plug 216 is in an unset position shown in FIG. 25A. Additional adapters, such as top cap 24 can be used to couple the actuating mandrel 222 to the setting tool 12, shown in FIG. 26B. Annular wedge 262 is also coupled to the setting tool via sleeve adapter 210, shown in FIG. 26C. Top cap 24, actuating mandrel 222 and sleeve adapter 210 can be included in adapter kit apparatus 14. Once coupled to adapter kit apparatus 14 and setting tool 12, plug 216 can be lowered to a desired setting location in casing 300 of a well. Via adapter kit apparatus 14, setting tool 12 can move actuating mandrel 222 axially upwards relative to sleeve adapter 210. This relative motion forces wedge 262 downwards into sealing ring 264 and slip 266, which are forced in the opposite direction by action of the actuating mandrel 222 that slides setting ring 270 upward along collet fingers 268. As wedge 262 is forced into the sealing ring 264 and slip 266, its tapered outer surface 267 forces the sealing ring 264 and slip segments, such as segments 266*a*, 266*b* and 266*c*, to expand radially until the sealing ring 264 and slip segments 266 are jammed between wedge outer surface 267 and casing 300. Sealing ring 264 now forms a seal between wedge outer surface 267 and casing 300. When slip 266 can move no further and the force required to pull the actuating mandrel 222 exceeds a desired limit, frangible fasteners 278 break, releasing the actuating mandrel 222 along with the adapter kit apparatus 14 and setting tool 12 from the plug 216, as shown in FIG. 25B.

After the setting tool 12 and adapter kit apparatus 14 have been removed from the well, a frac ball 76 can be dropped into the well. Preferably, seat 291 receives the frac ball 76 to occlude the wedge bore 263 and seal the axial passage of the annular wedge 262. Seat 291 can include an tapered surface shaped to engage the surface of the frac ball 76 to form a fluid-tight seal. Preferably when plug 216 is set, the seat surface is located at a level between the upper and lower ends of slip segments 266. With the seat 291 located within the wedge bore 263, fluid pressure that may be applied above the plug can cause the frac ball 76 to push downward and also exert additional radial force through the tapered seat 291 to slip segments, including segments 266*a*, 266*b* and 266*c*, further securing plug 216 in casing 300.

According to one embodiment, plug 216 can be assembled from its component parts in the following manner. Annular wedge 262 can be held vertically, with collet fingers 268 facing upward. Sealing ring 264 can be placed on wedge 262 to rest on wedge outer surface 267 so that lip 289 faces towards the collet fingers 268. Slip segments, including segments 266*a*, 266*b* and 266*c* can be arranged annularly on wedge 262 with the slip lip 273 of each segment engaging lip 289 of sealing ring 264. Setting ring 270 can then be placed over collet fingers 268 and on top of the annular slip, with keys 271 inserted into slots 269. Gauge ring 280 can then be fixed to collet fingers 268 with appropriate fasteners 285. Perimeter wall 282 surrounds the setting ring 270 and extends to retain the lower ends of slip segments 266 in an annular arrangement.

Thus it is seen that the apparatus and methods disclosed herein readily achieve the ends and advantages mentioned as well as those inherent therein. While certain preferred embodiments have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A plug apparatus, comprising:

an annular wedge having a wedge first end and a wedge second end, the wedge having an axial wedge passage therethrough from the wedge first end to the wedge second end, the wedge having an inner seat defined in the wedge passage for receiving and seating a ball, the wedge having a tapered outer surface adjacent the wedge second end, the tapered outer surface increasing in outside diameter from the wedge second end toward the wedge first end;

wherein the annular wedge includes a plurality of collet fingers extending from the wedge second end and circumferentially spaced to form slots between the collet fingers, each collet finger extending through the axial slip passage to a distal end beyond the slip second end;

a sealing ring received about the tapered outer surface of the wedge, the sealing ring being radially expandable; and an annular slip having a slip first end and a slip second end, the slip having an axial slip passage therethrough from the slip first end to the slip second end, the slip passage having a tapered inner surface adjacent the slip first end, the tapered inner surface decreasing in inside diameter from the slip first end toward the slip second end, the wedge second end being received in the slip first end so that the tapered outer surface of the wedge engages the tapered inner surface of the slip, and the slip first end faces the sealing ring for abutment with the sealing ring.

2. The apparatus of claim 1, wherein the sealing ring includes:

an annular ring body having a tapered ring bore complementary to the tapered outer surface of the wedge, the ring body having an annular inner groove defined in the ring bore, and the ring body having an annular outer groove defined in a radially outer surface of the ring body;

an inner elastomeric seal received in the inner groove; and an outer elastomeric seal received in the outer groove.

3. The apparatus of claim 1, wherein:

the annular slip comprises a plurality of separate slip segments.

4. The plug apparatus of claim 1, wherein the inner seat is located in the wedge passage axially below the upper end of the wedge passage.

5. The plug apparatus of claim 1, wherein the inner seat is located in the wedge passage axially below the midpoint of the tapered outer surface of the wedge.

6. The apparatus of claim 1, further comprising:

a setting ring slidably mounted around the collet fingers between the slip second end and the distal end of each collet finger, the setting ring having an outer diameter, a first radial thickness, and one or more keys that protrude radially inward into one or more of the slots from the first radial thickness to a second radial thickness.

7. The apparatus of claim 6, further comprising:

a gauge ring fixably connected to the distal end of the collet fingers having an outer diameter at least the same as the outer diameter of the setting ring or greater.

8. The apparatus of claim 7, wherein:

the setting ring is located adjacent to the gauge ring and to the slip second end, and wherein the gauge ring includes a peripheral annular wall that extends around the setting ring and extends at least to the slip second end.

9. The apparatus of claim 7, wherein:

the setting ring is slidable between an unset position wherein the slip and the sealing ring are each in a first radial position and wherein the setting ring is located adjacent to the gauge ring and to the slip second end; and a set position wherein the slip and the sealing ring are each radially expanded from the first radial position to a second radial position wherein the setting ring is displaced along the collet fingers towards the wedge second end and the adjacent slip and sealing ring are correspondingly displaced towards the wedge first end.

10. The apparatus of claim 9 further comprising:

a mandrel connected to a setting tool, the mandrel extending through the axial wedge passage and releasably coupled to the setting ring via a frangible coupling, an annular sleeve adapter connected to the setting tool and coupled to the first wedge end of the annular wedge, wherein the setting tool is configured to displace the mandrel axially relative to the annular sleeve adapter and thereby move the setting ring from the unset position to the set position.

11. A plug apparatus, comprising:

an annular slip, wherein the slip includes a plurality of separate slip segments disposed adjacently to one another, the slip having an upper end and a lower end and having a slip bore extending from the upper end to the lower end, the slip bore being inwardly tapered from the upper end toward the lower end;

a wedge having a tapered lower outer surface portion received in the upper end of the slip and engaging the tapered slip bore, the wedge having a wedge bore having an upwardly facing annular seat defined therein, a plurality of collet fingers circumferentially spaced in an annular arrangement and extending axially from a lower end of the tapered lower outer surface portion, each collet finger extending through the slip bore to a distal end beyond the slip lower end, a setting ring abutting the slip lower end and slidably located on the plurality of collet fingers between the slip lower end and the distal end of the collet fingers; and a sealing ring received about the tapered lower outer surface portion of the wedge above the slip upper end, the sealing ring being configured to be engaged by the slip upper end.

12. The apparatus of claim 11, wherein:

a gauge ring is fixably connected to the distal end of the collet fingers, the gauge ring having an outer diameter greater than an outer diameter of the setting ring.

13. The apparatus of claim 11, wherein:

the collet fingers are circumferentially spaced to form slots therebetween, and the setting ring has an outer diameter, a first radial thickness, and one or more keys that protrude radially inward into one or more of the slots from the first radial thickness to a second radial thickness.

14. The apparatus of claim 11, wherein:

the wedge is movable downward, relative to the setting ring, the slip and the sealing ring, from an unset position wherein the slip and the sealing ring are each in a first radial position, to a set position wherein the slip and the sealing ring are radially expanded from their respective first radial positions to respective expanded second radial positions.

15. The apparatus of claim 14, wherein:

the sealing ring includes an annular ring body constructed of a sufficiently ductile material such that the ring body can expand radially to the expanded second radial position of the sealing ring without breaking.

16. A method of setting a plug in a casing bore, the method comprising:

(a) initially retaining a wedge and a slip in an unset axially extended position with a lower tapered outer surface of the wedge received in an upper tapered inner bore of the slip, and with a sealing ring received about the wedge above the slip and engaged with an upper end of the slip;

(b) while the wedge and the slip are retained in the unset position, running the plug into a casing to a casing location to be plugged; and (c) setting the plug in the casing by forcing the wedge axially into the slip and the sealing ring, thereby;

(1) radially expanding the slip to anchor the plug in the casing; and (2) radially expanding the sealing ring without breaking to seal between the plug and the casing; wherein an outer elastomeric sealing member carried on the ring body seals against the casing and an inner elastomeric sealing member carried by the ring body seals against the wedge.

17. The method of claim 16, further comprising:

after step (c), sealing a ball in an annular seat defined in an axial bore of the wedge to close the frac plug.

18. The method of claim 16, wherein:

the wedge includes a plurality of collet fingers in an annular arrangement extending axially from a lower end of the wedge, each collet finger extending through the bore of the slip to a distal end beyond a lower end of the slip, the wedge further including a setting ring abutting the lower end of the slip and slidably located on the plurality of collet fingers between the lower end of the slip and the distal end of the collet fingers; and step (c) includes moving the setting ring in the direction of the abutting lower end of the slip so as to force the wedge axially into the slip and the sealing ring.

19. The method of claim 18, wherein:

the wedge includes a gauge ring fixably connected to the distal end of the collet fingers, the gauge ring having an outer diameter greater than an outer diameter of the setting ring, and wherein in step (b), running the plug into a casing includes retaining the setting ring adjacent to the slip and to the gauge ring, wherein the gauge ring includes a peripheral wall that extends axially to the slip.

20. The method of claim 19, further comprising:

prior to step (b), connecting a mandrel to a setting tool, the mandrel extending through an axial wedge passage and an axial slip passage, coupling the mandrel to the setting ring via a frangible coupling.

* * * * *